US008943841B2

(12) United States Patent
Lee et al.

(10) Patent No.: US 8,943,841 B2
(45) **Date of Patent: *Feb. 3, 2015**

(54) LNG TANK SHIP HAVING LNG CIRCULATING DEVICE

(75) Inventors: Jung Han Lee, Geoje-Si (KR); Jung Ho Choi, Geoje-Si (KR); Sung Kon Han, Geoje-Si (KR); Dong Kyu Choi, Geoje-Si (KR); Young Sik Moon, Geoje-Si (KR)

(73) Assignee: Daewoo Shipbuilding & Marine Engineering Co., Ltd., Seoul (KR)

( * ) Notice: Subject to any disclaimer, the term of this patent is extended or adjusted under 35 U.S.C. 154(b) by 1371 days.

This patent is subject to a terminal disclaimer.

(21) Appl. No.: 12/429,139

(22) Filed: Apr. 23, 2009

(65) Prior Publication Data

US 2009/0211262 A1 Aug. 27, 2009

Related U.S. Application Data

(63) Continuation of application No. 11/828,999, filed on Jul. 26, 2007, and a continuation of application No. 11/829,012, filed on Jul. 26, 2007, and a continuation of application No. 11/829,026, filed on Jul. 26, 2007, now Pat. No. 8,028,724.

(30) Foreign Application Priority Data

Feb. 12, 2007 (KR) ..... 10-2007-0014405
Apr. 30, 2007 (KR) ..... 10-2007-0042103

(51) Int. Cl.
*F17C 13/02* (2006.01)
*F17C 1/00* (2006.01)
(Continued)

(52) U.S. Cl.
CPC ... *F17C 1/00* (2013.01); *F17C 3/00* (2013.01); *F17C 1/12* (2013.01);
(Continued)

(58) Field of Classification Search
USPC ..... 62/45.1, 47.1, 48.1, 50.2, 52.1, 53.2, 62/611, 49.1, 52.3, 50.1, 51.1, 49.2
See application file for complete search history.

(56) References Cited

U.S. PATENT DOCUMENTS 1,995,320 A 3/1935 Murray
2,784,560 A * 3/1957 Johnson, Jr. ..... 62/47.1
(Continued)

FOREIGN PATENT DOCUMENTS

CN 85105351 A 4/1987
EP 0293832 A2 12/1988
(Continued)

OTHER PUBLICATIONS

Co-pending U.S. Appl. No. 12/556,418, filed Sep. 9, 2009.
(Continued)

*Primary Examiner* — Marc Norman
*Assistant Examiner* — Devon Russell
(74) *Attorney, Agent, or Firm* — Knobbe, Martens, Olson & Bear, LLP

(57) ABSTRACT

Disclosed is a liquefied natural gas storage apparatus. The apparatus includes a heat insulated tank and liquefied natural gas contained in the tank. The tank has heat insulation sufficient to maintain liquefied natural gas therein such that most of the liquefied natural gas stays in liquid. The contained liquefied natural gas has a vapor pressure from about 0.3 bar to about 2 bar. The apparatus further includes a safety valve configured to release a part of liquefied natural gas contained in the tank when a vapor pressure of liquefied natural gas within the tank becomes higher than a cut off pressure. The cut off pressure is from about 0.3 bar to about 2 bar.

16 Claims, 10 Drawing Sheets

(51) Int. Cl.
*F17C 3/00* (2006.01)
*F17C 1/12* (2006.01)

(52) U.S. Cl.
CPC .. *F17C 2201/0157* (2013.01); *F17C 2201/052* (2013.01); *F17C 2203/03* (2013.01); *F17C 2205/0332* (2013.01); *F17C 2205/0352* (2013.01); *F17C 2221/033* (2013.01); *F17C 2223/0161* (2013.01); *F17C 2223/033* (2013.01); *F17C 2223/043* (2013.01); *F17C 2225/047* (2013.01); *F17C 2227/0157* (2013.01); *F17C 2227/0178* (2013.01); *F17C 2227/0339* (2013.01); *F17C 2250/0408* (2013.01); *F17C 2250/043* (2013.01); *F17C 2250/0443* (2013.01); *F17C 2250/0495* (2013.01); *F17C 2250/0621* (2013.01); *F17C 2250/0631* (2013.01); *F17C 2250/0694* (2013.01); *F17C 2250/072* (2013.01); *F17C 2260/02* (2013.01); *F17C 2260/031* (2013.01); *F17C 2265/03* (2013.01); *F17C 2265/031* (2013.01); *F17C 2265/034* (2013.01); *F17C 2265/05* (2013.01); *F17C 2270/0105* (2013.01); *F17C 2270/0123* (2013.01); *F17C 2270/0171* (2013.01); *F17C 2270/0173* (2013.01); *F17C 2270/0178* (2013.01)
USPC ..... 62/49.2; 62/50.1

(56) References Cited

U.S. PATENT DOCUMENTS

| | | | | |
|---|---|---|---|---|
| 2,952,984 | A | 9/1960 | Marshall, Jr. | |
| 3,123,981 | A * | 3/1964 | Carney et al. | 62/48.1 |
| 3,150,495 | A * | 9/1964 | Reed | 62/48.2 |
| 3,282,060 | A | 11/1966 | Hays | |
| 3,407,052 | A | 10/1968 | Huntress et al. | |
| 3,420,068 | A | 1/1969 | Petit | |
| 3,434,492 | A | 3/1969 | Yearwood et al. | |
| 3,453,836 | A | 7/1969 | Kerr | |
| 3,733,838 | A * | 5/1973 | Delahunty | 62/48.2 |
| 3,763,658 | A | 10/1973 | Gaumer, Jr. et al. | |
| 3,828,709 | A | 8/1974 | Bognaes et al. | |
| 3,837,172 | A | 9/1974 | Markbreiter et al. | |
| 3,837,821 | A | 9/1974 | Buffiere et al. | |
| 3,842,613 | A | 10/1974 | Becker | |
| 3,857,245 | A * | 12/1974 | Jones | 60/651 |
| 3,874,185 | A | 4/1975 | Etzbach | |
| 3,886,758 | A | 6/1975 | Perrotin et al. | |
| 3,919,852 | A * | 11/1975 | Jones | 62/7 |
| 4,033,135 | A | 7/1977 | Mandrin | |
| 4,041,721 | A | 8/1977 | Kniel | |
| 4,054,433 | A | 10/1977 | Buffiere et al. | |
| 4,065,278 | A | 12/1977 | Newton et al. | |
| 4,083,318 | A | 4/1978 | Verolme | |
| 4,095,546 | A | 6/1978 | Kane | |
| 4,129,432 | A | 12/1978 | Garside | |
| 4,315,408 | A | 2/1982 | Karl | |
| 4,345,861 | A | 8/1982 | Aarseth | |
| 4,382,524 | A | 5/1983 | Kvamsdal | |
| 4,417,878 | A | 11/1983 | Koren | |
| 4,598,554 | A | 7/1986 | Bastian | |
| 4,826,354 | A | 5/1989 | Adorian | |
| 4,846,862 | A | 7/1989 | Cook | |
| 4,924,822 | A * | 5/1990 | Asai et al. | 123/27 GE |
| 5,114,451 | A | 5/1992 | Rambo et al. | |
| 5,137,558 | A | 8/1992 | Agrawal | |
| 5,139,547 | A | 8/1992 | Agrawal et al. | |
| 5,226,931 | A | 7/1993 | Combier | |
| 5,325,673 | A | 7/1994 | Durr et al. | |
| 5,373,702 | A | 12/1994 | Kalet et al. | |
| 5,375,547 | A | 12/1994 | Abe et al. | |
| 5,531,178 | A | 7/1996 | Abe et al. | |
| 5,542,255 | A | 8/1996 | Preston et al. | |
| 5,572,875 | A | 11/1996 | Gustafson | |
| 5,586,513 | A | 12/1996 | Jean et al. | |
| 5,685,159 | A | 11/1997 | Kooy et al. | |
| 5,711,270 | A | 1/1998 | Pedersen | |
| 5,727,492 | A | 3/1998 | Cuneo et al. | |
| 6,023,942 | A | 2/2000 | Thomas et al. | |
| 6,035,795 | A | 3/2000 | Dhellemmes et al. | |
| 6,089,022 | A | 7/2000 | Zednik et al. | |
| 6,237,347 | B1 | 5/2001 | Rigby et al. | |
| 6,378,722 | B1 | 4/2002 | Dhellemmes | |
| 6,449,983 | B2 | 9/2002 | Pozivil | |
| 6,530,241 | B2 * | 3/2003 | Pozivil | 62/619 |
| 6,564,579 | B1 | 5/2003 | McCartney | |
| 6,732,881 | B1 | 5/2004 | Gulati | |
| 6,829,901 | B2 | 12/2004 | Harley et al. | |
| 6,964,180 | B1 * | 11/2005 | Shivers, III | 62/611 |
| 6,964,181 | B1 | 11/2005 | Milios et al. | |
| 7,100,261 | B2 | 9/2006 | Gulati | |
| 7,165,408 | B2 | 1/2007 | Immel | |
| 7,201,002 | B1 | 4/2007 | Brown | |
| 7,219,502 | B2 | 5/2007 | Nierenberg | |
| 7,322,387 | B2 | 1/2008 | Landry et al. | |
| 7,404,301 | B2 | 7/2008 | Huang et al. | |
| 7,438,012 | B2 * | 10/2008 | Kackur | 114/74 A |
| 7,448,223 | B2 | 11/2008 | Darling, IV et al. | |
| 7,464,734 | B2 | 12/2008 | Liu | |
| 7,493,778 | B2 * | 2/2009 | Engdahl | 62/614 |
| 7,644,676 | B2 | 1/2010 | Lee et al. | |
| 7,726,359 | B2 | 6/2010 | Hartono et al. | |
| 7,841,288 | B2 | 11/2010 | Lee et al. | |
| 8,028,724 | B2 | 10/2011 | Lee et al. | |
| 2001/0042377 | A1 | 11/2001 | Pozivil | |
| 2003/0000949 | A1 | 1/2003 | Dhellemmes | |
| 2003/0014981 | A1 | 1/2003 | Kimble et al. | |
| 2003/0054307 | A1 * | 3/2003 | Gerstendorfer et al. | 431/117 |
| 2003/0106324 | A1 | 6/2003 | Bishop | |
| 2004/0068993 | A1 * | 4/2004 | Irie et al. | 62/48.2 |
| 2004/0221718 | A1 * | 11/2004 | Grodal | 95/90 |
| 2005/0016185 | A1 | 1/2005 | Emmer et al. | |
| 2005/0042035 | A1 | 2/2005 | de Baan | |
| 2005/0126220 | A1 | 6/2005 | Ward | |
| 2006/0053806 | A1 | 3/2006 | Tassel | |
| 2006/0086412 | A1 | 4/2006 | Spittael et al. | |
| 2006/0156744 | A1 | 7/2006 | Cusiter et al. | |
| 2007/0009369 | A1 * | 1/2007 | Dany | 417/323 |
| 2007/0125122 | A1 | 6/2007 | Mak et al. | |
| 2007/0128957 | A1 | 6/2007 | Korsgaard | |
| 2007/0149838 | A1 | 6/2007 | Chretien | |
| 2007/0214831 | A1 * | 9/2007 | Nanda | 62/614 |
| 2008/0008602 | A1 * | 1/2008 | Pozivil et al. | 417/243 |
| 2008/0034769 | A1 | 2/2008 | Engdahl | |
| 2008/0127673 | A1 | 6/2008 | Bowen et al. | |
| 2008/0148771 | A1 | 6/2008 | Yengle et al. | |
| 2008/0153369 | A1 | 6/2008 | Hartono et al. | |
| 2008/0190117 | A1 * | 8/2008 | Lee et al. | 62/47.1 |
| 2008/0190118 | A1 | 8/2008 | Lee et al. | |
| 2008/0190352 | A1 | 8/2008 | Lee et al. | |
| 2008/0245101 | A1 | 10/2008 | Dubettier-Grenier et al. | |
| 2009/0126400 | A1 * | 5/2009 | Pozivil | 62/611 |
| 2009/0199591 | A1 | 8/2009 | Lee et al. | |
| 2009/0199759 | A1 | 8/2009 | Lee et al. | |
| 2009/0259081 | A1 | 10/2009 | Lee et al. | |
| 2009/0266086 | A1 * | 10/2009 | Lee et al. | 62/48.1 |
| 2010/0012015 | A1 | 1/2010 | Lee et al. | |
| 2010/0122542 | A1 | 5/2010 | Choi et al. | |
| 2012/0017608 | A1 | 1/2012 | Lee et al. | |
| 2012/0260674 | A1 | 10/2012 | Lee et al. | |
| 2013/0306643 | A1 | 11/2013 | Lee et al. | |

FOREIGN PATENT DOCUMENTS

| | | | | |
|---|---|---|---|---|
| EP | 0535752 | A1 | 4/1993 | |
| EP | 1561683 | A1 | 8/2005 | |
| JP | 46-20123 | B | 6/1971 | |
| JP | 54-159720 | A | 12/1979 | |
| JP | 58-046299 | | 3/1983 | |
| JP | 58-072800 | A | 4/1983 | |
| JP | 58072800 | A * | 4/1983 | F17C 3/00 |
| JP | 10-028837 | A | 2/1998 | |

(56) References Cited

FOREIGN PATENT DOCUMENTS

| | | | |
|---|---|---|---|
| JP | 2005-320311 | A | 11/2005 |
| JP | 2007-527445 | A | 9/2007 |
| KR | 10-1990-0005143 | A | 4/1990 |
| KR | 10-0184706 | B1 | 5/1999 |
| KR | 10-1999-0046828 | A | 7/1999 |
| KR | 10-2000-0011346 | A | 2/2000 |
| KR | 10-2000-0011347 | A | 2/2000 |
| KR | 10-2001-0014021 | A | 2/2001 |
| KR | 10-2001-0014033 | A | 2/2001 |
| KR | 10-0289546 | B1 | 5/2001 |
| KR | 10-2001-0049264 | A | 6/2001 |
| KR | 10-2001-0060256 | A | 7/2001 |
| KR | 10-2001-0082235 | A | 8/2001 |
| KR | 10-2001-0083920 | A | 9/2001 |
| KR | 10-2001-0088406 | A | 9/2001 |
| KR | 10-2001-0089142 | A | 9/2001 |
| KR | 10-2004-0015294 | A | 2/2004 |
| KR | 10-2004-0018265 | A | 3/2004 |
| KR | 10-2004-0046835 | A | 6/2004 |
| KR | 10-2004-0046836 | A | 6/2004 |
| KR | 10-0441857 | A | 7/2004 |
| KR | 10-0489804 | B1 | 5/2005 |
| KR | 10-0499710 | B1 | 7/2005 |
| KR | 10-2005-0094798 | A | 9/2005 |
| KR | 10-2005-0094799 | A | 9/2005 |
| KR | 20-0394721 | Y1 | 9/2005 |
| KR | 10-2005-0102681 | A | 10/2005 |
| KR | 10-2006-0036441 | A | 4/2006 |
| KR | 10-2006-0083727 | A | 7/2006 |
| KR | 10-0618735 | B1 | 8/2006 |
| KR | 10-0644217 | B1 | 11/2006 |
| KR | 20-0431697 | Y1 | 11/2006 |
| KR | 20-2006-0000158 | U | 12/2006 |
| KR | 10-0674451 | B1 | 1/2007 |
| KR | 10-2007-0020162 | A | 2/2007 |
| KR | 10-2007-0045172 | A | 5/2007 |
| KR | 10-2007-0084510 | A | 8/2007 |
| KR | 10-2007-0091323 | A | 9/2007 |
| KR | 10-2007-0100760 | A | 10/2007 |
| KR | 10-2009-0086916 | A | 8/2009 |
| WO | 90-00589 | A1 | 1/1990 |
| WO | 98/43029 | A1 | 10/1998 |
| WO | 98/59084 | A1 | 12/1998 |
| WO | 98/59085 | A1 | 12/1998 |
| WO | 00/23164 | A2 | 4/2000 |
| WO | 00/25061 | A1 | 5/2000 |
| WO | 02-32810 | A1 | 4/2002 |
| WO | 03/002921 | A1 | 1/2003 |
| WO | 2005-015100 | A1 | 2/2005 |
| WO | 2005/047761 | A1 | 5/2005 |
| WO | 2005/056377 | A2 | 6/2005 |
| WO | 2005/071333 | A1 | 8/2005 |

OTHER PUBLICATIONS

International Code for the Construction and Equipment of Ships Carrying Liquefied Gases in Bulk (IGC Code), 1993, pp. 31-34, IMO, London.

International Code for the Construction and Equipment of Ships Carrying Liquefied Gases in Bulk (IGC Code), 2000, Chapter 15, IMO, London.

Search Report from the corresponding European Patent Application No. 07007424.0 dated Jul. 11, 2007.

Dr. K-D. Gerdsmeyer et al., On-Board Reliquefaction for LNG Ships, 2005, 14 pages.

International Search Report dated Sep. 16, 2009 of corresponding PCT Application No. PCT/KR2009/000623 filed on Feb. 11, 2008—3 pages.

N.G. Krillov, Analysis of Modern Natural Gas Liquefaction Technologies, Chemical and Petroleum Engineering, 2004, vol. 40, Issue 7-8, pp. 401-406.

Notice Allowance dated Jun. 15, 2011 of corresponding U.S. Appl. No. 11/829,026—8 pages.

Office Action dated Apr. 15, 2011 from the U.S. Patent Office in corresponding U.S. Appl. No. 11/828,999.

Office Action dated Apr. 18, 2011 from the U.S. Patent Office in corresponding U.S. Appl. No. 11/829,012.

Office Action dated Feb. 28, 2011 from the U.S. Patent Office in corresponding U.S. Appl. No. 11/829,026.

Written Opinion dated Sep. 16, 2009 of corresponding PCT Application No. PCT/KR2009/000623 filed on Feb. 11, 2008—4 pages.

Co-pending U.S. Appl. No. 12/567,639, filed Sep. 25, 2009.

Chinese Second Office Action, re CN Application No. 200910223692.5, dated Jan. 13, 2012, with translation.

International Search Report, and its English Translation, dated Sep. 16, 2009 of corresponding PCT Application No. PCT/KR2009/000623; filed Feb. 11, 2008 (5 pages).

Written Opinion, and its English Translation, dated Sep. 16, 2009 of corresponding PCT Application No. PCT/KR2009/000623; filed Feb. 11, 2008 (11 pages).

* cited by examiner

LNG TANK SHIP HAVING LNG CIRCULATING DEVICE

CROSS-REFERENCE TO RELATED PATENT APPLICATIONS

This application is a continuation application of U.S. application Ser. Nos. 11/828,999, 11/829,012 and 11/829,026, filed Jul. 26, 2007, now pending, which claim priority to and the benefit of Korean Patent Application Nos. 10-2007-0014405 filed Feb. 12, 2007 and 10-2007-0042103 filed Apr. 30, 2007, the disclosures of which are incorporated herein by reference in their entirety.

BACKGROUND

1. Field

The present disclosure relates to a liquefied natural gas tank.

2. Discussion of the Related Technology

Generally, natural Gas (NG) is turned into a liquid (also called liquefied natural gas or LNG) in a liquefaction plant, transported over a long distance by an LNG carrier, and re-gasified by passing a floating storage and re-gasification unit (FSRU) or an unloading terminal on land to be supplied to consumers.

In case LNG is transported by an LNG re-gasification vessel (LNG-RV), LNG is re-gasified in the LNG-RV itself, not passing a FSRU or an unloading terminal on land, and then supplied directly to consumers.

As liquefaction of natural gas occurs at a cryogenic temperature of approximately −163° C. at ambient pressure, LNG is likely to be vaporized even when the temperature of the LNG is slightly higher than −163° C. at ambient pressure. Although an LNG carrier has a thermally insulated LNG storage tank, as heat is continually transferred from the outside to the LNG in the LNG storage tank, the LNG is continually vaporized and boil-off gas is generated in the LNG storage tank during the transportation of LNG. If boil-off gas is generated in an LNG storage tank as described above, the pressure of the LNG storage tank is increased and becomes dangerous.

Generally, to maintain a constant pressure within the LNG storage tank for an LNG carrier, the boil-off gas generated in the LNG storage tank is consumed as a fuel for propulsion of the LNG carrier. That is to say, LNG carriers for transporting LNG basically maintain the temperature of the LNG in the LNG storage tank at approximately −163° C. at ambient pressure by discharging the boil-off gas to the outside of the tank.

For example, a steam turbine propulsion system driven by the steam generated in a boiler by burning the boil-off gas generated in an LNG storage tank has a problem of low propulsion efficiency. Also, a dual fuel diesel electric propulsion system, which uses the boil-off gas generated in an LNG storage tank as a fuel for a diesel engine after compressing the boil-off gas, has higher propulsion efficiency than the steam turbine propulsion system. But it has difficulty in maintenance due to complicated integration of a medium-speed diesel engine and an electric propulsion unit in the system. In addition, this system employs a gas compression method which requires higher installation and operational costs than a liquid compression method. Further, such method using boil-off gas as a fuel for propulsion fails to achieve the efficiency similar to or higher than that of a two-stroke slow-speed diesel engine, which is used in ordinary ships.

There is also a method of re-liquefying the boil-off gas generated in an LNG storage tank and returning the re-liquefied boil-off gas to the LNG storage tank. However, this method of re-liquefying the boil-off gas has a problem of installing a complicated boil-off gas re-liquefaction plant in the LNG carrier.

Furthermore, when the amount of boil-off gas generated in an LNG storage tank exceeds the capacity of a propulsion system or a boil-off gas re-liquefaction plant, the excessive boil-off gas needs to be burnt by a gas combustion unit or gas burner. Consequently, such method has a problem of needing an auxiliary unit such as a gas combustion unit for treating excessive boil-off gas.

For example, as illustrated in FIG. 4, in a case of an exemplary LNG carrier which basically maintains an almost constant pressure in an LNG storage tank, the LNG storage tank is somewhat hot for the first time (for 3 to 5 days after LNG is loaded therein). Consequently, as indicated by the solid line at the upper part of the diagram, a considerably large amount of excessive boil-off gas, compared with the amount of natural boil-off gas (NBOG), is generated during the transportation of LNG, and this excessive boil-off gas exceeds the amount of fuel consumed by a boiler or duel fuel diesel electric propulsion system. Accordingly, the amount of boil-off gas corresponding to the area indicated by oblique lines which shows a difference from the dotted line at a lower part of the diagram illustrating the amount of boil-off gas used in a boiler or engine may need to be burnt by a gas combustion unit (GCU). In addition, when an LNG carrier passes a canal (e.g. between 5 and 6 days in FIG. 4), as boil-off gas cannot not consumed in a boiler or engine (when the LNG carrier is waiting to enter a canal), or a small mount of boil-off gas is consumed (when the LNG carrier is passing a canal), the excessive boil-off gas which has not been consumed for propulsion of an engine needs be burnt. Further, even when the LNG carrier with LNG loaded therein is waiting to enter port or entering port, none or a small amount of boil-off gas is consumed, and consequently the excessive boil-off gas needs be burnt.

In a case of an LNG carrier having a capacity of 150,000 $m^3$, boil-off gas burnt as described above amounts to 1500 to 2000 tons per year, which cost about 700,000 USD, and the burning of boil-off gas raises a problem of environmental pollution.

Korean Patent Laid-Open Publication Nos. KR 10-2001-0014021, KR 10-2001-0014033, KR 10-2001-0083920, KR 10-2001-0082235, and KR 10-2004-0015294 disclose techniques of suppressing the generation of boil-off gas in an LNG storage tank by maintaining the pressure of the boil-off gas in the LNG storage tank at a high pressure of approximately 200 bar (gauge pressure) without installing a thermal insulation wall in the LNG storage tank, unlike the low-pressure tank as described above. However, this LNG storage tank have a significantly high thickness to store boil-off gas having a high pressure of approximately 200 bar, and consequently it has problems of increasing manufacturing costs and requiring additional components such as a high-pressure compressor, to maintain the pressure of boil-off gas at approximately 200 bar. There is also a technique of a pressure tank, which is different from the above-mentioned technique. As highly volatile liquid is stored in a super high-pressure tank, for example, at a pressure higher that 200 bar and at the room temperature, this super high-pressure tank does not have a problem of treating boil-off gas, but has other problems that the tank should be small, and that the manufacturing costs are increased.

As stated above, an LNG storage tank for an LNG carrier, which maintains the pressure of cryogenic liquid constant near ambient pressure during the transportation of the LNG and allows generation of boil-off gas, has a problem of consuming a large amount of boil-off gas or installing an additional re-liquefaction apparatus. In addition, a method of transporting LNG using a tank, such as a high pressure tank, which withstands a high pressure at a high temperature, unlike a tank which transports said cryogenic liquid at a low atmospheric pressure, does not need to treat boil-off gas, but has a limitation on the size of the tank and requires high manufacturing costs.

The discussion in this section is to provide general background information and does not constitute an admission of prior art.

SUMMARY

One aspect of the invention provides an LNG tank ship, comprising: at least one heat insulated tank configured to contain LNG in both liquid and gaseous phases therein, wherein the at least one tank has a volume; a primary engine of the ship for generating power to move the ship, wherein the engine is designed to use a fuel other than LNG such that the engine does not use LNG to reduce vapor pressure of the LNG within the tank; and at least one liquefier configured to convert at least a portion of gaseous phase LNG to liquid phase LNG, wherein the at least one liquefier has a processing capacity, which is the maximum amount of gaseous phase LNG to be processed by the at least one liquefier for one hour, wherein a ratio of the processing capacity to the volume is smaller than about 0.015 kg/m$^3$.

In the foregoing ship, the ratio may be smaller than about 0.01 kg/m$^3$. The ratio may be smaller than about 0.005 kg/m$^3$. The ratio may be smaller than about 0.002 kg/m$^3$. The volume may be greater than about 100,000 m$^3$. The processing capacity may be smaller than about 3000 kg/hour. The ship may not comprise a conduit for in fluid communication between the at least one tank and the engine. The ship may comprise a first conduit and a second conduit, wherein the first conduit is configured to flow the portion of the gaseous phase LNG from the at least one tank to the at least one liquefier, wherein the second conduit is configured to flow liquid phase LNG from the at least one liquefier to the at least one tank. The ship may further comprise LNG contained in the tank, wherein a substantial portion of the LNG is in liquid, and wherein the LNG within the tank has a vapor pressure from about 0.3 bar to about 2 bar. The vapor pressure may be from about 0.5 bar to 1 bar.

Another aspect of the invention provides an LNG tank ship, comprising: at least one heat insulated tank configured to contain LNG in both liquid and gaseous phases therein; a primary engine of the ship for generating power to move the ship, wherein the engine is designed to use a fuel other than LNG such that the engine does not use LNG to reduce vapor pressure of the LNG within the tank; and at least one liquefier configured to convert at least a portion of gaseous phase LNG to liquid phase LNG, the at least one liquefier has a processing capacity, which is the maximum amount of gaseous phase LNG to be processed by the at least one liquefier for one hour, wherein the processing capacity is smaller than about 3000 kg/hour.

In the foregoing ship, the processing capacity may be smaller than about 1000 kg/hour. The ship may not comprise a conduit for in fluid communication between the at least one tank and the engine. The ship may further comprise a first conduit and a second conduit, wherein the first conduit is configured to flow the portion of the gaseous phase LNG from the at least one tank to the at least one liquefier, wherein the second conduit is configured to flow liquid phase LNG from the at least one liquefier to the at least one tank.

Still another aspect of the invention provides a liquefier-free LNG tank ship, comprising: at least one heat insulated tank configured to contain LNG in both liquid and gaseous phases therein; a primary engine of the ship for generating power to move the ship, wherein the engine is designed to use a fuel other than LNG such that the engine does not use LNG to reduce vapor pressure of the LNG within the tank; and wherein the ship does not comprise a liquefier that is configured to convert at least a portion of gaseous phase LNG to liquid phase LNG.

In the foregoing ship, the ship may not comprise a conduit for in fluid communication between the at least one tank and the engine. The ship may further comprise LNG contained in the tank, wherein a substantial portion of the LNG is in liquid, and wherein the LNG within the tank may have a vapor pressure from about 0.3 bar to about 2 bar. The vapor pressure may be from about 0.5 bar to 1 bar. The ship may further comprise a flowing device configured to flow a portion of the LNG from one location within the tank to another location within the tank. The flowing device may comprise a conduit which is located inside the tank.

Yet another aspect of the invention provides a method of receiving LNG from an LNG tank containing LNG, the method comprising: providing a receiving tank; connecting between the receiving tank and an LNG tank containing LNG such that a fluid communication between the receiving tank and the LNG tank is established; and receiving at least part of the LNG into the receiving tank from the LNG tank, in which the LNG has a vapor pressure from about 0.3 bar to about 2 bar.

In the foregoing method, the vapor pressure within the LNG tank may be from about 0.4 bar to about 1.5 bar. The vapor pressure within the LNG tank may be from about 0.5 bar to about 1 bar. The vapor pressure within the LNG tank may be from about 0.65 bar to about 0.75 bar. The vapor pressure within the LNG tank may be greater than that within the receiving tank. The LNG tank may be integrated with a ship, and wherein the receiving tank is located on a shore. The LNG tank may be integrated with a ship, and wherein the receiving tank is located inland substantially away from a shore. The method may further comprises: providing an additional receiving tank; connecting between the additional receiving tank and the LNG tank such that a fluid communication between the additional receiving tank and the LNG tank is established; and receiving at least part of the LNG into the additional receiving tank from the LNG tank, wherein receiving into the additional receiving tank is simultaneously performed with receiving into the receiving tank for at least some time.

A further aspect of the invention provides a method of unloading LNG from an LNG tank containing LNG to a receiving tank, the method comprising: providing an LNG tank comprising LNG, which has a vapor pressure from about 0.3 bar to about 2 bar; connecting between the LNG tank and a receiving tank such that a fluid communication between the receiving tank and the LNG tank is established; and unloading at least part of the LNG from the LNG tank to the receiving tank.

In the foregoing method, the vapor pressure within the LNG tank may be from about 0.4 bar to about 1.5 bar. The vapor pressure within the LNG tank may be from about 0.5 bar to about 1 bar. The vapor pressure within the LNG tank may be from about 0.65 bar to about 0.75 bar. The vapor pressure within the LNG tank may be greater than that within the receiving tank. The LNG tank may be integrated with a ship, and wherein the receiving tank is located on a shore. The LNG tank may be integrated with a ship, and wherein the receiving tank is located inland substantially away from a shore. The method may further comprises: providing an additional receiving tank; connecting between the additional receiving tank and the LNG tank such that a fluid communication between the additional receiving tank and the LNG tank is established; and receiving at least part of the LNG into the additional receiving tank from the LNG tank, wherein receiving into the additional receiving tank is simultaneously performed with receiving into the receiving tank for at least some time.

A still further aspect of the invention provides an apparatus for containing LNG, the apparatus comprising: a heat insulated tank; and LNG contained in the tank; wherein a substantial portion of the LNG is in liquid, and wherein the LNG within the tank has a vapor pressure from about 0.3 bar to about 2 bar.

In the foregoing apparatus, the tank may comprise heat insulation sufficient to maintain a substantial portion of the liquefied natural in liquid for an extended period. The vapor pressure may be from about 0.4 bar to about 1.5 bar. The vapor pressure may be from about 0.5 bar to about 1 bar. The vapor pressure may be from about 0.65 bar to about 0.75 bar. The LNG within the tank may have a temperature from about −159° C. to about −146° C. The tank may have a volume greater than about 100,000 $m^3$. The apparatus may further comprise a flowing device configured to flow a portion of the LNG from one location within the tank to another location within the tank. The flowing device may comprise a conduit which is located inside the tank. The flowing device may comprise a conduit, at least part of which is located outside the tank. The tank may comprises an interior wall defining an interior space configured to contain LNG; an exterior wall substantially surrounding the interior wall; and the heat insulation interposed between the interior wall and the exterior wall. The apparatus may further comprise a safety valve configured to release part of LNG from the tank when a vapor pressure within the tank reaches a cut off pressure of the safety valve.

A ship may comprise the foregoing apparatus, wherein the tank may be integrated with a body of the ship. A vehicle may comprise the foregoing apparatus, wherein the tank is integrated with a body of the vehicle. The vehicle may be selected from the group consisting of a train, a car and a trailer.

A yet further aspect of the invention provides a method of operating a LNG storage apparatus, the method comprising: pro viding the foregoing LNG storage apparatus; monitoring the amount of the LNG within the tank; and changing the cut off pressure from a first value to a second value when the amount of the LNG within the tank is decreased, wherein the second value is greater than the first value, wherein the second value is from about 0.3 bar to about 2 bar. The second value may be from about 0.5 bar to about 1 bar.

A still another further aspect of the invention provides a method of operating a LNG storage apparatus, the method comprising: providing the foregoing LNG storage apparatus; and monitoring a vapor pressure of the LNG in the tank wherein the vapor pressure is from about 0.3 bar to 2 bar. The method may further comprise comparing the vapor pressure to a reference pressure so as to determine whether to initiate a safety measure, wherein the reference pressure is from about 0.3 bar to about 2 bar. The reference pressure may be from about 0.5 bar to about 1 bar.

One aspect of the present invention provides a somewhat high-pressure (near ambient pressure) tank for transporting LNG in a cryogenic liquid state. Another aspect of the present invention provides an LNG storage tank having a large capacity which can be manufactured without increasing manufacturing costs and which can reduce the waste of boil-off gas, and to provide a method for transporting LNG, or a method for treating boil-off gas, using said LNG storage tank.

DETAILED DESCRIPTION OF EMBODIMENTS

Figure 1:
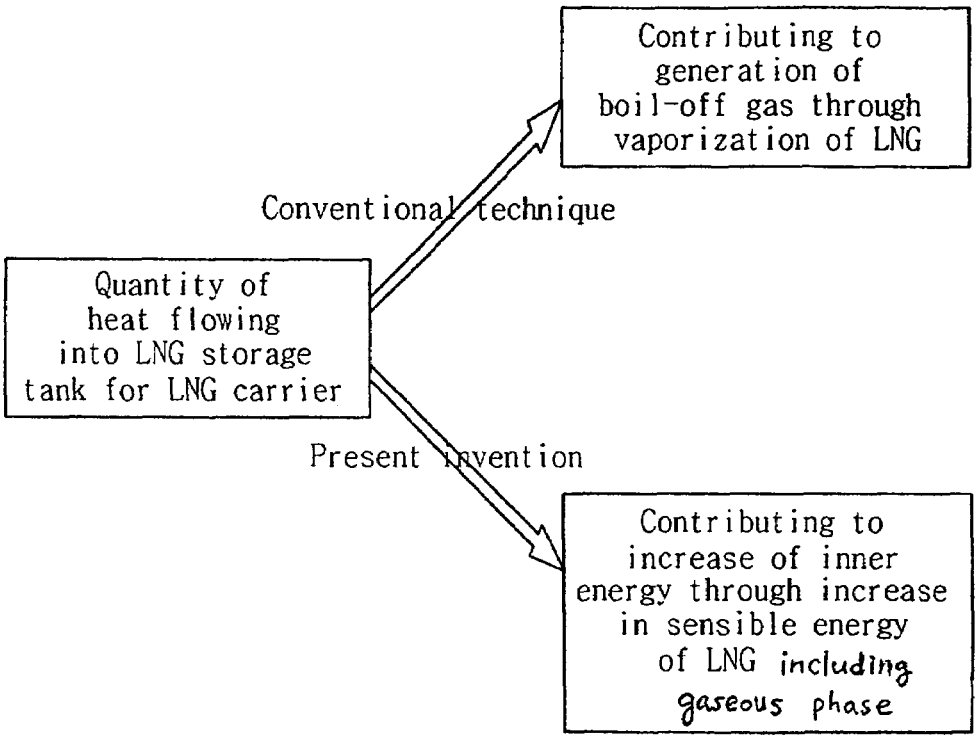
FIG. 1 is a schematic view illustrating the concept of absorption of heat ingress into an LNG storage tank for an LNG carrier according to an embodiment of the present invention.

Hereinafter, various embodiments of the invention will be described with reference to the accompanying drawings.

Embodiments of the present invention provides a somewhat high-pressure (near ambient pressure) LNG storage tank for transporting LNG in a cryogenic liquid state, characterized in that some degree of change in the pressure in the LNG storage tank is allowed during the transportation of LNG.

One embodiment of the present invention provides, in an LNG carrier having boil-off gas treatment means for treating the boil-off gas generated in an LNG storage tank, an LNG carrier and a method characterized in that the vapor pressure in the LNG storage tank and the temperature of the LNG are allowed to be increased during the transportation of the LNG in the LNG storage tank.

In general, the methods known as means for treating boil-off gas are as follows: (a) using the boil-off gas generated from an LNG storage tank for a boiler (e.g. a steam turbine propulsion boiler); (b) using the boil-off gas as a fuel of a gas engine such as a DFDE and MEGI; (c) using the boil-off gas for a gas turbine; and (d) re-liquefying the boil-off gas and returning the re-liquefied boil-off gas to the LNG storage tank (see Korean Patent Laid-Open Publication No. 2004-0046836, Korean Patent Registration Nos. 0489804 and 0441857, and Korean Utility Model Publication No. 2006-0000158). These methods have problems of waste of boil-off gas by a boil-off gas combustion means such as a gas combustion unit (GCU) for excessive boil-off gas exceeding the capacity of a general boil-off gas treating means (e.g. after LNG is loaded), or the boil-off gas when the boil-off gas cannot be treated by the boil-off gas treating means, e.g. when an LNG carrier enters or leaves port and when it passes a canal.

Embodiments of the present invention have an advantage of eliminating such waste of boil-off gas by improving flexibility in boil-off gas treatment. The LNG carrier according to an embodiment of the present invention may not require a GCU, or may require a GCU for improving flexibility in treating, handling or managing boil-off gas in an emergency.

The LNG carrier according to an embodiment of the present invention is equipped with boil-off gas treating means such as a boiler, re-liquefaction apparatus, and gas engine for treating the boil-off gas generated from an LNG storage tank by discharging the boil-off gas to the outside of the LNG storage tank.

An embodiment of the present invention provides, in a method for controlling a safety valve provided at an upper portion of an LNG storage tank for an LNG carrier, a method for setting the safety valve characterized in that the cut off pressure of the safety valve during the loading of LNG differs from the cut off pressure of the safety valve during the voyage of the LNG carrier. An embodiment of the present invention also provides a safety valve, an LNG storage tank, and an LNG carrier having said feature.

Generally, the pressure in an LNG storage tank is safely managed by installing a safety valve at an upper portion of the LNG storage tank for an LNG carrier which transports LNG in a cryogenic liquid state. Some exemplary methods of safely managing the pressure in an LNG storage tank are as follows: (a) safeguarding against a possible explosion of an LNG storage tank by means of a safety valve; and (b) treating the boil-off gas generated from the LNG storage tank, after LNG is loaded, by the above-mentioned methods including using the boil-off gas for a boiler (e.g. a steam turbine propulsion boiler), using the boil-off gas as a fuel of a gas engine such as a DFDE and MEGI, using the boil-off gas for a gas turbine, and re-liquefying the boil-off gas and returning the re-liquefied boil-off gas to the LNG storage tank. These methods have problems of waste of boil-off gas by a boil-off gas combustion means such as a GCU for excessive boil-off gas which exceeds a capacity of a general boil-off gas treating means after LNG is loaded in an LNG carrier), or the boil-off gas when an LNG carrier enters or leaves a port, and when it passes a canal. The pressure in an LNG storage tank for an LNG carrier is maintained within a predetermined range by the above discussed methods.

Volume of LNG and Cut Off Pressure of Safety Valve

In an LNG carrier, when the set value or cut off pressure of a safety valve is 0.25 bar, about 98% of the full capacity of an LNG storage tank in volume can be loaded with LNG in liquid phase and the remaining about 2% is left as an empty space. If more than about 98% of the full capacity of an LNG storage tank is loaded with LNG, when the vapor pressure of the LNG storage tank reaches 0.25 bar, the LNG in the LNG storage tank may overflows from the dome at an upper portion of the tank. As shown in an embodiment of the present invention, if the pressure of LNG in an the LNG storage tank is continually allowed to be increased after the LNG is loaded, even when a small amount of LNG is loaded, the LNG in the LNG storage tank may overflow due to the expansion of the LNG caused by an increase in the temperature of the LNG at the cut off pressure of the safety valve according to an embodiment of the present invention. For example, Applicants have found that, when the vapor pressure in an LNG storage tank is 0.7 bar, even if 97% of the full capacity of the LNG storage tank is loaded with LNG, the LNG in the LNG storage tank may overflow. This directly results in reducing the amount of LNG to be loaded.

Control of the Cut Off Pressure of Safety Valve

Accordingly, instead of uniformly fixing the cut off pressure of a safety valve provided at an upper portion of an LNG storage tank to a somewhat high pressure near ambient pressure, it is possible to reduce the waste of boil-off gas or increase the flexibility in treatment of boil-off gas without reducing an initial LNG load, by fixing the cut off pressure of a safety valve to a lower pressure, e.g. about 0.25 bar, as in an LNG carrier, during loading of LNG, and then increasing the cut off pressure of the safety valve, as in an embodiment of the present invention, when the amount of LNG in the LNG storage tank is reduced by using some boil-off gas (e.g. using the boil-off gas as a fuel of a boiler or engine) after the LNG carrier starts voyage. An embodiment of the present invention, if applied to an LNG carrier equipped with boil-off gas treating means (e.g. a boiler, a re-liquefaction apparatus, or a gas engine) for treating the boil-off gas generated from an LNG storage tank by discharging the boil-off gas to the outside of the LNG storage tank, has a great effect in eliminating the waste of boil-off gas.

Accordingly, in an embodiment of the present invention, the cut off pressure of a safety valve is increased after the amount of LNG in an LNG storage tank is reduced by discharging the boil-off gas generated in the LNG storage tank to the outside thereof. Preferably the cut off pressure during the loading of LNG is set at about 0.25 bar or lower; and the pressure during the voyage of the LNG carrier is set from a value greater than 0.25 bar to about 2 bar, and more preferably, from a value greater than 0.25 bar to about 0.7 bar. Here, the cut off pressure of a safety valve during the voyage of an LNG carrier may be increased gradually, e.g. from about 0.4 bar to about 0.7 bar, according to the amount of boil-off gas used according to the voyage conditions.

Accordingly, in an embodiment of the present invention, the expression "during the voyage of an LNG carrier" means when the volume of LNG in an LNG storage tank is somewhat reduced by use of some boil-off gas after the LNG carrier starts voyage with LNG loaded therein. For example, it is desirable to set the cut off pressure of a safety valve at 0.25 bar when the volume of LNG in liquid phase in an LNG storage tank is about 98.5%, at about 0.4 bar when the volume of LNG in liquid phase is about 98.0%, about 0.5 bar when the volume of LNG in liquid phase is about 97.7%, and about 0.7 bar when the volume of LNG is about 97.1%.

An embodiment of the present invention provides an LNG storage tank for an LNG carrier for transporting LNG in a cryogenic liquid state, characterized in that the cut off pressure of a safety valve provided at an upper portion of the LNG storage tank is set from higher than about 0.25 bar to about 2 bar, preferably from higher than about 0.25 bar to about 0.7 bar, and more preferably approximately 0.7 bar. An embodiment of the present invention also provides a method for setting a safety valve, an LNG storage tank, and an LNG carrier having said technical feature. In one embodiment, the cut off pressure of the safety valve is about 0.3 bar to about 2 bar. In certain embodiments, the cut off pressure of the safety valve is about 0.26 bar, about 0.3 bar, about 0.35 bar, about 0.4 bar, about 0.45 bar, about 0.5 bar, about 0.55 bar, about 0.6 bar, about 0.65 bar, about 0.7 bar, about 0.75 bar, about 0.8 bar, about 0.9 bar, about 1 bar, about 1.2 bar, about 1.5 bar, about 2 bar, about 3 bar. In some embodiments, the cut off pressure may be within a range defined by two of the foregoing cut off pressures.

Certain embodiments of the present invention allows setting of cut-off pressure of the safety valve from about 0.3 bar to about 2 bar, and thus, allows some increases of the vapor pressure in the LNG storage tank and the temperature of the LNG in the LNG tank during the voyage.

Vapor Pressure of within the Tank

An embodiment of the present invention provides an LNG storage tank for an LNG carrier for transporting LNG in a cryogenic liquid state, characterized in that the vapor pressure in the LNG storage tank is controlled within near-ambient pressure, and that the vapor pressure in the LNG storage tank and the pressure of the LNG in the LNG storage tank are allowed to be increased during the transportation of the LNG. The LNG storage tank is also characterized in that the vapor pressure in the LNG storage tank ranges from a value greater than 0.25 bar to about 2 bar, preferably from higher than 0.25 bar to 0.7 bar, and more preferably, approximately 0.7 bar. In one embodiment, the vapor pressure is about 0.3 bar to about 2 bar. In certain embodiments, the vapor pressure is about 0.26 bar, about 0.3 bar, about 0.35 bar, about 0.4 bar, about 0.45 bar, about 0.5 bar, about 0.55 bar, about 0.6 bar, about 0.65 bar, about 0.7 bar, about 0.75 bar, about 0.8 bar, about 0.9 bar, about 1 bar, about 1.2 bar, about 1.5 bar, about 2 bar, about 3 bar. In some embodiments, the vapor pressure may be within a range defined by two of the foregoing vapor pressures.

Uniform Temperature Distribution

In addition, the LNG storage tank is characterized in that the boil-off gas at an upper portion of the LNG storage tank is mixed with the LNG at a lower portion of the LNG storage tank so as to maintain a uniform temperature distribution in the LNG storage tank. On one hand, as more LNG is likely to be vaporized when the temperature of one part of the LNG storage tank is higher than the temperature of the other part thereof, it is desirable to maintain a uniform temperature distribution of the LNG or boil-off gas in the LNG storage tank. On the other hand, as the boil-off gas at an upper portion of the LNG storage tank has a smaller heat capacity than the LNG at a lower portion of the LNG storage tank, local sharp increase in the temperature at an upper portion of the LNG storage tank due to the heat ingress from the outside into the LNG storage tank may result in a sharp increase in the pressure in the LNG storage tank. The sharp increase in the pressure in the LNG storage tank can be avoid by mixing the boil-off gas at an upper portion of the LNG storage tank with the LNG at a lower portion of the LNG storage tank.

Operation of LNG Tank in view of Unloading Condition

Also, according to an embodiment of the present invention, the vapor pressure in an LNG storage tank for an LNG carrier can be controlled to match the pressure in an LNG storage tank or reservoir for receiving the LNG at an LNG terminal. For example, in case where the pressure in an LNG storage tank or reservoir of an LNG unloading terminal, an LNG-RV, or a FSRU is relatively high (e.g. from approximately 0.4 bar to about 0.7 bar), the vapor pressure in the LNG storage tank for an LNG carrier is continually increased during the voyage of the LNG carrier. Otherwise, in case where the pressure in an LNG storage tank or reservoir of an LNG unloading terminal is low (approximately 0.2 bar), the pressure in the LNG storage tank for an LNG carrier may be controlled to match the pressure of the LNG storage tank for receiving the LNG by using the flexibility in boil-off gas treatment with reducing the waste of boil-off gas according to an embodiment of the present invention.

Configurations of the LNG Tank

In addition, an embodiment of the present invention provides a method for transporting LNG in a cryogenic liquid state having said technical feature, and an LNG carrier having said LNG storage tank. In particular, according to an embodiment of the present invention, the membrane LNG storage tank having a somewhat high pressure near ambient pressure to transport LNG in a cryogenic liquid state is characterized in that some degree of change in the pressure in the LNG storage is allowed during the transportation of LNG. The membrane tank according to an embodiment of the present invention may be a cargo space of an LNG tank as defined in IGC Code (2000). In an embodiment, a membrane tank is a non-self-supporting tank having a thermal insulation wall formed in a body and having a membrane formed at an upper portion of the tank. In an embodiment, the term "membrane tank" is used to include a semi-membrane tank. Some examples of the membrane tank are GTT NO 96-2 and Mark III as described below, and tanks as described in Korean Patent Nos. 499710 and 644217.

In an embodiment of the invention, a membrane tank can be designed to withstand the pressure up to about 0.7 bar (gauge pressure) by reinforcing the tank. However, it is generally prescribed that a membrane tank should be designed to have the pressure not exceeding 0.25 bar. Thus, all typical membrane tanks comply with this regulation, and are managed so that the vapor pressure in the tank is 0.25 bar or lower, and that the temperature and pressure of the LNG are almost constant during the voyage. On the contrary, an embodiment of the present invention is characterized in that the tank is configured to be sustainable to a vapor pressure greater than 0.25, preferably from about 0.3 bar to about 2 bar, and preferably from about 0.3 bar to about 0.7 bar, and the vapor pressure in the tank and the temperature of the LNG are allowed to be increased until the vapor pressure becomes the sustainable pressure discussed in the above. Also, the LNG storage tank according to an embodiment of the present invention is characterized by an apparatus for maintaining a uniform temperature distribution in the LNG storage tank.

According to an embodiment of the present invention, a large LNG carrier has an LNG storage capacity or volume about 100,000 $m^3$ or more. In one embodiment, the storage capacity is greater than about 50,000 $m^3$. In certain embodiments, the storage capacity is about 50,000 $m^3$, about 70,000 $m^3$, about 80,000 $m^3$, about 90,000 $m^3$, about 100,000 $m^3$, about 110,000 $m^3$, about 120,000 $m^3$, about 130,000 $m^3$, about 15,000 $m^3$, about 170,000 $m^3$, about 200,000 $m^3$ or about 300,000 $m^3$. In some embodiments, the storage capacity may be within a range defined by two of the foregoing capacities. In case of manufacturing a tank having a relative pressure of approximately 1 bar, near atmospheric pressure, as in an embodiment of the present invention, the manufacturing costs are not sharply increased, and also the tank can transport LNG, substantially withstanding the pressure generated by boil-off gas and not treating the boil-off gas.

The LNG storage tank according to an embodiment of the present invention is applicable to an LNG carrier, an LNG floating and re-gasification unit (FSRU), an unloading terminal on land, and an LNG re-gasification vessel (LNG-RV), etc. The LNG storage tank has advantages of reducing the waste of boil-off gas by allowing increase in the pressure and temperature in the LNG storage tank and solving a problem of treating boil-off gas, and of increasing flexibility in LNG treatment, such as transporting and storing LNG, because it is possible to store LNG in said all kinds of LNG storage tanks for a long time, taking into account LNG demand.

LNG Tank Allowing Vapor Pressure Increase

FIG. 1 shows a concept of the absorption of the heat ingress into an LNG storage tank for an LNG carrier according to an embodiment of the present invention. In a general exemplary tank, the pressure in an LNG storage tank for an LNG carrier is maintained within a predetermined range, and most of the heat ingress from the outside into the LNG storage tank makes contribution to generation of boil-off gas, all of which should be treated or used in the LNG carrier. On the contrary, according to an embodiment of the present invention, the pressure in an LNG storage tank for an LNG carrier is allowed to be increased, thereby increasing saturation temperature, and accordingly, most of the heat is absorbed by sensible heat increase of LNG including natural gas (NG) in the LNG storage tank, which is caused by the increase in saturation temperature, thereby noticeably reducing the generation of boil-off gas. For example, when the pressure of the LNG storage tank for an LNG carrier is increased to about 0.7 bar from an initial pressure of about 0.06 bar, the saturation temperature is increased by approximately 6° C.

Figure 2:
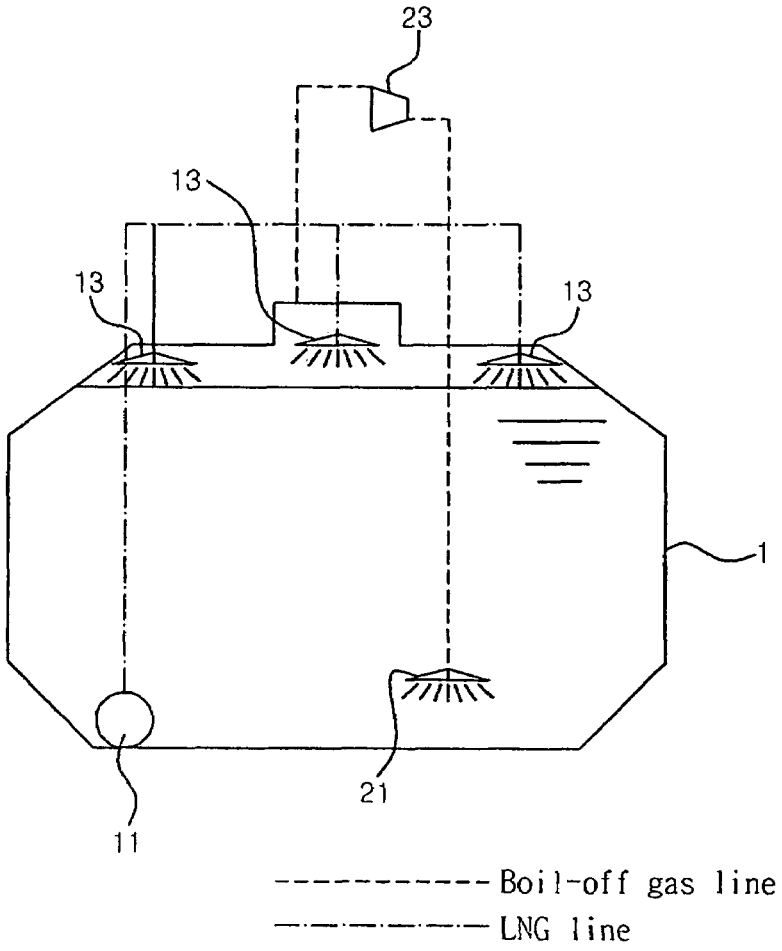
FIG. 2 is a schematic diagram illustrating an LNG storage tank for an LNG carrier according to an embodiment of the present invention.

FIG. 2 schematically illustrates an LNG storage tank for an LNG carrier according to an embodiment of the present invention. In an LNG storage tank 1 for an LNG carrier which has a thermal insulation wall formed therein, in case LNG is normally loaded, the pressure in the LNG storage tank 1 is approximately 0.06 bar (gauge pressure) when the LNG carrier starts voyage, and the pressure is gradually increased due to the generation of boil-off gas during the voyage of the LNG carrier. For example, the pressure in the LNG storage tank 1 for an LNG carrier is about 0.06 bar right after LNG is loaded into the LNG storage tank 1 at a location where LNG is produced, and can be increased up to about 0.7 bar when the LNG carrier arrives at a destination after about 15-20 days of voyage.

Relationship Between Pressure and Temperature

With regard to temperature, LNG which generally contains many impurities has a lower boiling point than that of pure methane. The pure methane has a boiling point of about −161° C. at about 0.06 bar, and LNG for transportation which contains impurities such as nitrogen, ethane, etc., has a boiling point of approximately −163° C. Assuming the LNG essentially consists of pure methane, LNG in an LNG storage tank after being loaded into the LNG storage tank has a temperature of approximately −161° C. at about 0.06 bar. If the vapor pressure in the LNG storage tank is controlled to be about 0.25 bar, taking into account the transportation distance and the consumption of boil-off gas, the temperature of the LNG is increased to approximately −159° C.; if the vapor pressure in the LNG storage tank is controlled to be about 0.7 bar, the temperature of the LNG is approximately −155° C.; if the vapor pressure in the LNG storage tank is controlled to be about 2 bar, the temperature of the LNG is increased up to approximately −146° C.

Heat Insulated LNG Tank Sustainable to High Pressure

The LNG storage tank for an LNG carrier according to the present an embodiment of invention comprises a thermal insulation wall and is designed by taking into account the pressure increase caused by the generation of boil-off gas. That is, the LNG storage tank is designed to have sufficient strength to withstand the pressure increase caused by the generation of boil-off gas. Accordingly, the boil-off gas generated in the LNG storage tank 1 for an LNG carrier is accumulated therein during the voyage of the LNG carrier.

The LNG storage tank 1 for an LNG carrier according to embodiments of the present invention preferably comprises a thermal insulation wall, and is designed to withstand the pressure from a value higher than 0.25 bar to about 2 bar (gauge pressure), and more preferably, the pressure of about 0.6 to about 1.5 bar (gauge pressure). Taking into account the transportation distance of LNG and the current IGC Code, it is desirable to design the LNG storage tank to withstand the pressure from a value higher than 0.25 bar to about 0.7 bar, particularly, approximately 0.7 bar.

In addition, as the LNG storage tank 1 for an LNG carrier according to an embodiment of the present invention can be sufficiently embodied by designing the LNG storage tank 1 to have a great thickness during an initial design, or simply by suitably reinforcing an general LNG storage tank for an LNG carrier through addition of a stiffener thereto without making a big change in the design of the LNG storage tank, it is economical in view of manufacturing costs.

Various LNG storage tanks for LNG carriers with a thermal insulation wall therein are as described below. The LNG storage tank installed in an LNG carrier can be classified into an independent-type tank and a membrane-type tank, and is described in detail below. GTT NO 96-2 and GTT Mark III in Table 1 below was renamed from GT and TGZ, respectively, when the Gaz Transport (GT) Corporation and Technigaz (TGZ) corporation was incorporated into GTT (Gaztransport & Technigaz) Corporation in 1995.

TABLE 1

Classification Table of LNG Storage Tanks

| | Membrane Type | | Independent Type | |
|---|---|---|---|---|
| Classification | GTT Mark III | GTT No. 96-2 | MOSS | IHI-SPB |
| Tank Material -- Thickness | SUS 304L -- 1.2 mm | Invar Steel 0.7 mm | Al Alloyed Steel (5083) -- 50 mm | Al Alloyed Steel (5083) -- Max. 30 mm |
| Heat Dissipation Material -- Thickness | Reinforced Polyurethane Foam -- 250 mm | Plywood Box + Perlite -- 530 mm | Polyurethane Foam -- 250 mm | Polyurethane Foam -- 250 mm |

GT type and TGZ type tanks are disclosed in U.S. Pat. No. 6,035,795, U.S. Pat. No. 6,378,722, and U.S. Pat. No. 5,586,513, US Patent Publication US 2003-0000949, Korean Patent Laid-Open Publication Nos. KR 2000-0011347, and KR 2000-0011346.

Korean Patent Nos. 499710 and 0644217 disclose thermal insulation walls embodied as other concepts. The above references disclose LNG storage tanks for LNG carriers having various types of thermal insulation walls, which are to suppress the generation of boil-off gas as much as possible.

Safety Valve

An embodiment of the present invention can be applied to LNG storage tanks for LNG carriers having various types of thermal insulation functions as stated above. Exemplary LNG storage tanks for LNG carriers including the tank disclosed in the references are designed to withstand the pressure of 0.25 bar or lower, and consume the boil-off gas generated in the LNG storage tanks as a fuel for propulsion of the LNG carriers or re-liquefy the boil-off gas to maintain the pressure in the LNG storage tank at about 0.2 bar or lower, e.g. about 0.1 bar, and burn part or all of the boil-off gas if the pressure in the LNG storage tank is increased beyond the value. In addition, these LNG storage tanks have a safety valve therein, and if the LNG storage tanks fail to control the pressure therein as stated above, boil-off gas is discharged to the outside of the LNG storage tanks through the safety valve (mostly, having cut off pressure of 0.25 bar).

On the contrary, in an embodiment of the present invention, the pressure of the safety valve is set from a value higher than 0.25 bar to about 2 bar, preferably from a value higher than 0.25 bar to about 0.7 bar, and more preferably approximately 0.7 bar.

Circulation of LNG within the Tank

In addition, the LNG storage tank according to an embodiment of the present invention is configured to reduce the pressure in the LNG storage tank by reducing the local increase in temperature and pressure of the LNG storage tank. The LNG storage tank maintains a uniform temperature distribution thereof by spraying the LNG in liquid phase, having a lower temperature, at a lower portion of the LNG storage tank, toward the boil-off gas, having a higher temperature, at an upper portion of the LNG storage tank, and by injection of the boil-off gas, having a higher temperature, at an upper portion of the LNG storage tank, toward the LNG, having a lower temperature, at a lower portion of the LNG storage tank.

In FIG. 2, the LNG storage tank 1 for an LNG carrier is provided at a lower portion thereof with an LNG pump 11 and a boil-off gas injection nozzle 21, and at an upper portion thereof with an LNG spray 13 and a boil-off gas compressor 23. The LNG pump 11 and the boil-off gas compressor 23 can be installed at an upper or lower portion of the LNG storage tank. The LNG, having a lower temperature, at a lower portion of the LNG storage tank 1 is supplied to the LNG spray 13 provided at an upper portion of the LNG storage tank by the LNG pump 11 and then sprayed toward the upper portion of the LNG storage tank 1, which has a higher temperature. The boil-off gas, having a higher temperature, at an upper portion of the LNG storage tank 1 is supplied to the boil-off gas injection nozzle 21 provided at a lower portion of the LNG storage tank 1 by the boil-off gas compressor 23 and then injected toward the lower portion of the LNG storage tank 1 which has a lower temperature. Thus, a uniform temperature distribution of the LNG storage tank 1 is maintained and ultimately the generation of boil-off gas is reduced.

Such reduction of generation of boil-off gas is particularly useful for gradually increasing the pressure in the LNG storage tank because the generation of boil-off gas in an LNG carrier without having boil-off gas treating means has direct connection with the increase in pressure in the LNG storage tank. In case of an LNG carrier having boil-off gas treating means, if the pressure in the LNG storage tank is increased, a certain amount of boil-off gas is discharged to the outside, thereby controlling the pressure in the LNG storage tank, and consequently, spray of LNG or injection of boil-off gas may not be needed during the voyage of the LNG carrier.

Loading of LNG

If LNG is loaded in a sub-cooled liquid state into an LNG carrier at a production terminal where LNG is produced, it is possible to reduce the generation of boil-off gas (or the increase in pressure) during the transportation of LNG to a destination. The pressure in the LNG storage tank for an LNG carrier may be a negative pressure (0 bar or lower) after LNG is loaded in a sub-cooled liquid state at a production terminal. To prevent the pressure from being decreased to a negative pressure, the LNG storage tank may contain nitrogen.

Unloading of LNG

During the voyage of an LNG carrier, the LNG storage tank 1 for an LNG carrier according to an embodiment of the present invention allows a pressure increase in the LNG storage tank 1 without discharging the boil-off gas generated in the LNG storage tank 1, thereby increasing the temperature in the LNG storage tank 1, and accumulating most of the heat influx as internal energy of LNG including a gaseous portion of the LNG in the LNG storage tank, and then treating the boil-off gas accumulated in the LNG storage tank 1 for an LNG carrier at an unloading terminal when the LNG carrier arrives at a destination.

Figure 3:
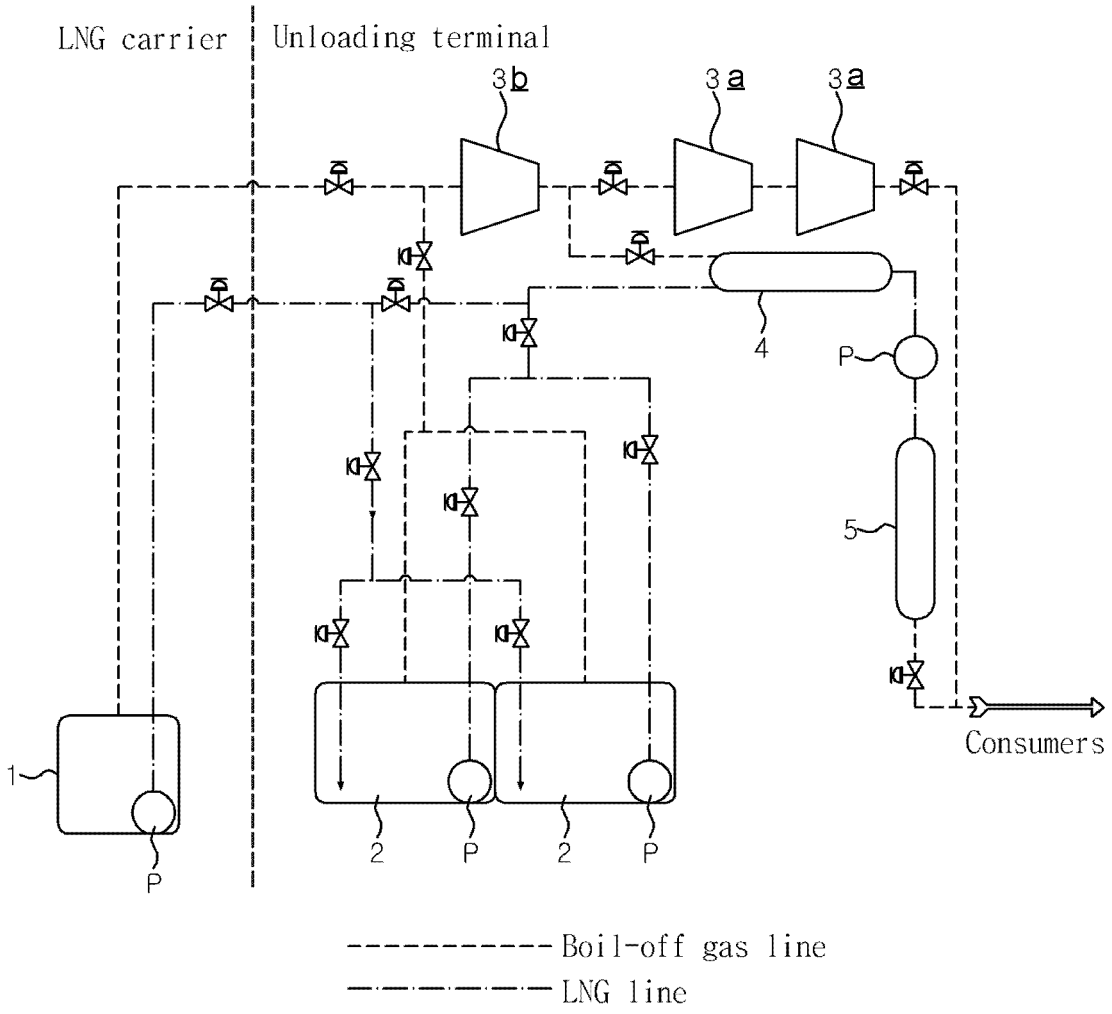
FIG. 3 is a schematic diagram illustrating a configuration for treating boil-off gas (BOG) at an unloading terminal by using an LNG storage tank for an LNG carrier according to an embodiment of the present invention.

FIG. 3 schematically illustrates a configuration for treating boil-off gas at an unloading terminal using the LNG storage tank for an LNG carrier according to an embodiment of the present invention. The unloading terminal is installed with a plurality of LNG storage tanks 2 for an unloading terminal, a high-pressure compressor 3*a*, a low-pressure compressor 3*b*, a re-condenser 4, a high-pressure pump P, and a vaporizer 5.

As a large amount of boil-off gas is accumulated in the LNG storage tank 1 for an LNG carrier, the boil-off gas in the LNG storage tank 1 is generally compressed to a pressure from about 70 bar to about 80 bar by the high-pressure compressor 3*a* at unloading terminals and then supplied directly to consumers. Part of the boil-off gas accumulated in the LNG storage tank 1 for an LNG carrier may generally be compressed to approximately 8 bar by the low-pressure compressor 3*b*, then re-condensed by passing the re-condenser 4, and then re-gasified by the vaporizer 5 so as to be supplied to consumers.

When LNG is unloaded from the LNG storage tank for an LNG carrier to be loaded into an LNG storage tanks or reservoirs for an unloading terminal, additional boil-off gas is generated due to inflow of LNG having a higher pressure into the LNG storage tanks for an unloading terminal because the pressure of the LNG storage tank for an LNG carrier is higher than that of the LNG storage tank for an unloading terminal. To minimize the generation of additional boil-off gas, LNG can be supplied to consumers by transmitting the LNG from the LNG storage tank for an LNG carrier directly to an inlet of a high-pressure pump at an unloading terminal. The LNG storage tank for an LNG carrier according to an embodiment of the present invention, as the pressure in the LNG storage tank is high during the unloading of LNG, has an advantage of shortening an unloading time by about 10% to about 20% over LNG storage tanks.

Instead of being supplied to the LNG storage tanks 2 for an unloading terminal at an unloading terminal, the LNG stored in the LNG storage tank 1 for an LNG carrier may be supplied to the re-condenser 4 to re-condense boil-off gas and then re-gasified by the vaporizer 5, thereby being supplied directly to consumers. On the other hand, if a re-condenser is not installed at an unloading terminal, LNG may be supplied directly to a suction port of the high-pressure pump P.

As stated above, if the plurality of LNG storage tanks 2 for an unloading terminal are installed at an unloading terminal and LNG is evenly distributed from the LNG storage tank 1 for an LNG carrier to each of the plurality of LNG storage tanks 2 for an unloading terminal, the effect of generation of boil-off gas in the LNG storage tanks for an unloading terminal can be minimized due to dispersion of boil-off gas to the plurality of the LNG storage tanks 2 for an unloading terminal. As the amount of boil-off gas generated in the LNG storage tanks for an unloading terminal is small, the boil-off gas is generally compressed by the low-pressure compressor 3*b* to approximately 8 bar and then re-condensed by passing the re-condenser 4, and then re-gasified by the vaporizer 5, to be supplied to consumers.

According to embodiments of the present invention, as the LNG storage tank for an LNG carrier is operated at a pressure greater than 0.25 bar, a process of filling boil-off gas in the LNG storage tank for an LNG carrier is not required to maintain the pressure in the LNG storage tank for an LNG carrier during the unloading of LNG. Further, if a LNG storage tank for an LNG terminal or for a floating storage and re-gasification unit (FSRU) are modified, or a new configuration of LNG storage tank for an unloading terminal or for a floating storage and re-gasification unit (FSRU) are constructed such that the pressure of the LNG storage tank provided in the unloading zone corresponds to the pressure of the LNG storage tank for an LNG carrier according to an embodiment of the present invention, no additional boil-off gas is generated during the unloading of LNG from the LNG carrier, and consequently an unloading technique can be applied.

According to an embodiment of the present invention, an LNG floating storage and re-gasification unit (FSRU) has more flexibility in management of boil-off gas and thus may not need a re-condenser. According to an embodiment of the present invention, the flash gas generation during unloading to the LNG floating storage and re-gasification unit (FSRU) from LNGC will be greatly reduced or absent and the operation time will be greatly reduced due to time saving of the flash gas handing. And accordingly there is much more flexibility for the cargo tank pressure of the unloading LNGC. According to an embodiment of the present invention, an LNG re-gasification vessel (LNG-RV) may have merits of both an LNG carrier and an LNG floating storage and re-gasification unit (FSRU) as stated above.

Operational Modes of the Tank

Figure 5:
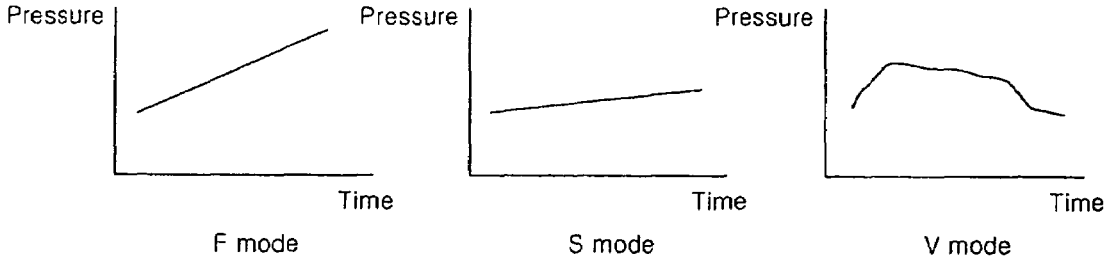
FIG. 5 is a diagram illustrating operation examples of an LNG storage tank for an LNG carrier during the voyage of the LNG carrier containing LNG therein.

FIG. 5 illustrates diagrams of operation types of an LNG storage tank for an LNG carrier during the voyage of the LNG carrier having LNG loaded therein, according to the pressure in the LNG storage tank at an LNG unloading terminal. F mode indicates the voyage of an LNG carrier, in which, for example, if the allowable pressure of the LNG storage tank at the unloading terminal ranges from about 0.7 bar to about 1.5 bar, the pressure in the LNG storage tank for the LNG carrier is allowed to be continually increased to a certain pressure similar to the allowable pressure of the LNG storage tank at an LNG unloading terminal. This mode is particularly useful in an LNG carrier without boil-off gas treating means.

S mode or V mode shown in FIG. 5 is appropriate when the allowable pressure of an LNG storage tank at an unloading terminal is smaller than 0.4 bar. The S and V modes are applicable to an LNG carrier having boil-off gas treating means. The S mode indicates the voyage of an LNG carrier in which the pressure in the LNG storage tank of the LNG carrier is allowed to be gradually increased, that is, continually increased to a certain pressure similar to the allowable pressure of the LNG storage tank of an LNG unloading terminal.

V mode is to enlarge the range of the pressure in the LNG storage tank for an LNG carrier, and has an advantage of reducing the waste of boil-off gas by storing the excessive boil-off gas exceeding the amount of boil-off gas consumed by boil-off gas treating means, in the LNG storage for an LNG carrier. For example, when an LNG carrier passes a canal, boil-off gas is not consumed because propulsion means using the boil-off gas as a fuel, such as a DFDE, MEGI, and gas turbine, does not operate. Accordingly, the boil-off gas generated in the LNG storage tank for an LNG carrier can be stored therein, and thus the pressure of the LNG storage tank for an LNG carrier increases to a pressure from about 0.7 bar to about 1.5 bar. After an LNG carrier passes a canal, the propulsion means using boil-off gas as a fuel is fully operated, thereby increasing the consumption of boil-off gas, and decreasing the pressure of the LNG storage tank for an LNG carrier to a pressure smaller than about 0.4 bar.

The operation types of an LNG storage tank for an LNG carrier can vary depending on whether or not a flash gas treatment facility for treating a large amount of flash gas is installed at an LNG unloading terminal. In case a flash gas treatment facility for treating a large amount of flash gas is installed at an LNG unloading terminal, the pressure of the LNG storage tank for an LNG carrier is operated in an F mode; in case a flash gas treatment facility for treating a large amount of flash gas is not installed at an LNG unloading terminal, the pressure of the LNG storage tank for an LNG carrier is operated according to the S mode or V mode.

Another Example of Circulation of LNG within the Tank

Figure 6:
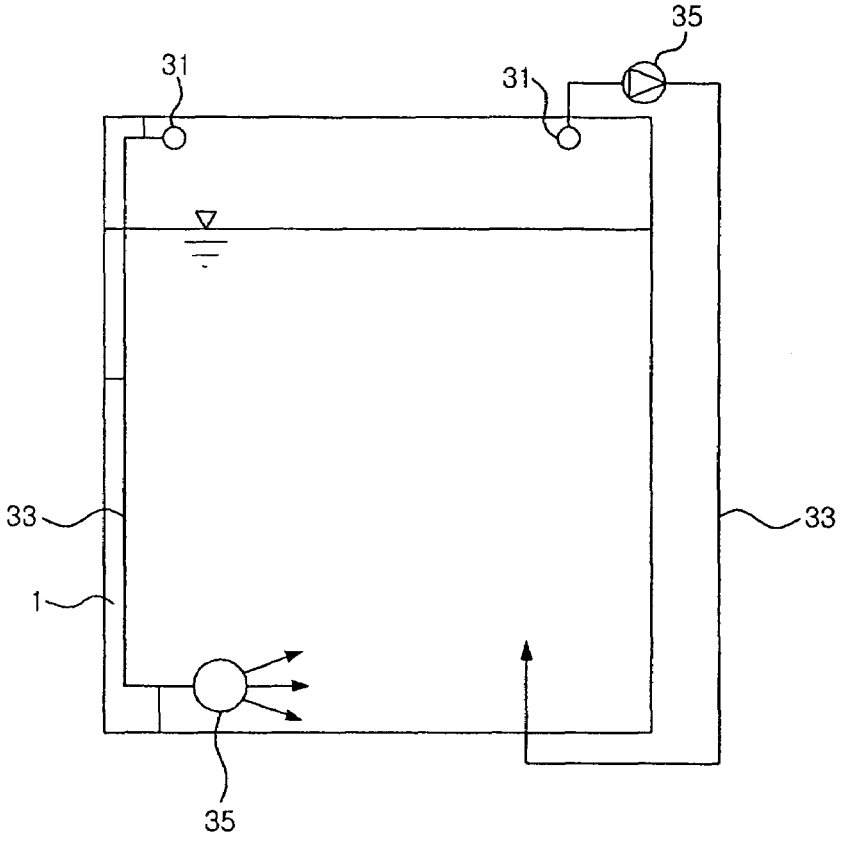
FIG. 6 is a diagram illustrating a configuration for transmitting a portion of boil-off gas from an upper portion of an LNG storage tank toward LNG at a lower portion of the LNG storage tank.

FIG. 6 illustrates an apparatus for reducing the pressure increase in an LNG storage tank for an LNG carrier by injection of the boil-off gas at an upper portion of the LNG storage tank toward the LNG at a lower portion thereof. The apparatus for reducing the pressure increase in the LNG storage tank for an LNG carrier as illustrated in FIG. 6 is configured to compress the boil-off gas at an upper portion of the LNG storage tank 1 for an LNG carrier and then to inject the compressed boil-off gas toward the LNG at an lower portion of the LNG storage tank 1. This apparatus comprises a boil-off gas suction port 31 provided at an upper portion of the LNG storage tank for an LNG carrier, a pipe 33 having one end connected to the boil-off gas suction port 31 and the other end connected to the lower portion of the LNG storage tank 1, and a compressor 35 provided at a portion of the pipe 33.

As illustrated in the left side of FIG. 6, the pipe 33 can be installed in the LNG storage tank 1. If the pipe 33 is installed in the LNG storage tank 1, it is desirable that the compressor 35 should be a submerged type compressor provided at a lower portion of the pipe 33. As illustrated in the right side of FIG. 6, the pipe 33 can be installed outside the LNG storage tank 1. If the pipe 33 is installed outside the LNG storage tank 1, the compressor 35 is an ordinary compressor provided at the pipe 33. It is desirable that liquid suction prevention means should be provided at the boil-off gas suction port 31. One example of the liquid suction prevention means is a demister.

The apparatus for reducing the pressure increase in the LNG storage for an LNG carrier is configured to reduce the local increase in the temperature and pressure of the LNG storage tank, thereby reducing the pressure of the LNG storage tank. The generation of boil-off gas can be reduced by injecting the boil-off gas, having a higher temperature, at an upper portion of the LNG storage tank 1 for an LNG carrier toward a lower portion of the LNG storage tank 1 for an LNG carrier having a lower temperature, thereby maintaining uniform temperature distribution of the LNG storage tank for an LNG carrier, that is, preventing the local increase in the temperature in the LNG storage tank.

Control of Safety Valve

Figure 7:
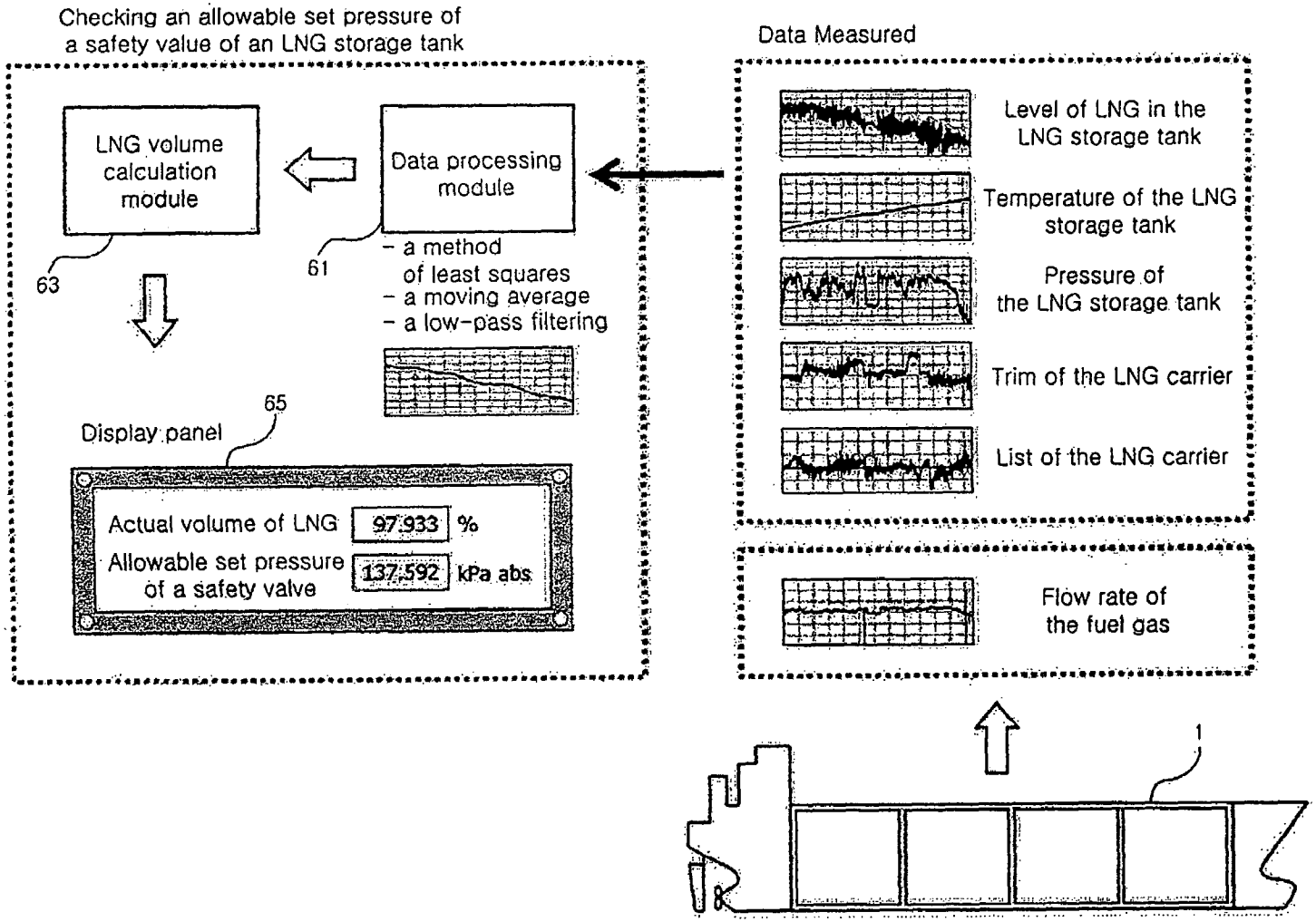
FIG. 7 is a diagram illustrating a system for displaying in real time an allowable cut off pressure of a safety valve of an LNG storage tank for an LNG carrier by acquiring and monitoring related data in real time and appropriately processing the related data during the voyage.

FIG. 7 illustrates a diagram of a system for displaying in real time a currently allowable maximum cut off pressure of an LNG storage tank for an LNG carrier by receiving related data in real time during the voyage of the LNG carrier, and appropriately processing and calculating the data. A safety valve of the LNG storage tank can be safely controlled by the system.

In case of an LNG carrier provided with a safety relief valve (SRV) or safety valve of the LNG storage tank therein, the cut off pressure of the safety valve is initially set low so as to maximize the cargo loading, but can be increased during the voyage according to the LNG volume decrease due to the consumption of boil-off gas.

The increased SRV cut off pressure can be obtained by volume and density of remained LNG according to IGC code 15.1.2. The LNG density can be accurately calculated by measuring LNG temperatures.

Monitoring the Level of LNG within the Tank

As the measured values such as the level of LNG in the LNG storage tank are frequently changed during the voyage, an embodiment of the present invention comprises a system for eliminating outside noise and fluctuation caused by dynamic movement of a ship through an appropriate data processing, a system for calculating an allowable cut off pressure of the safety valve of the LNG storage tank by calculating the actual volume of the LNG in the LNG storage tank 1 by using the processed data, and an apparatus for displaying the results.

FIG. 7 illustrates in the right side the related data measured to calculate the volume of the LNG in the LNG storage tank 1. The level of the LNG in the LNG storage tank is measured by a level gauge (not illustrated), the temperature of the LNG storage tank is measured by a temperature sensor (not illustrated), the pressure of the LNG storage tank is measured by a pressure sensor (not illustrated), the trim of the LNG carrier is measured by a trim sensor (not illustrated), and the list of the LNG carrier is measured by a list sensor (not illustrated). The trim of the LNG carrier indicates a front-to-back gradient of the LNG carrier, and the list of the LNG carrier indicates a left-to-right gradient of the LNG carrier.

The system for confirming a cut off pressure of the safety valve of the LNG storage tank according to the embodiment, as illustrated in the left side of FIG. 7, comprises a data processing module 61 for processing the measured data as illustrated in the right side of FIG. 7. It is desirable to process the data in the data processing module 61 by using a method of least squares, a moving average, or a low-pass filtering and so on. In addition, the system for confirming the cut off pressure of the safety valve of the LNG storage tank further comprises an LNG volume calculating module 63 for calculating the volume of the LNG in the LNG storage tank 1 by calculating the data processed in the data processing module 61. The system for confirming the cut off pressure of the safety valve of the LNG storage tank calculates an allowable cut off pressure of the safety valve of the LNG storage tank 1 from the volume of the LNG calculated by the LNG volume calculating module 63.

On the other hand, it is possible to measure the flow rate of the fuel gas supplied from the LNG storage tank 1 to fuel gas propulsion means of an LNG carrier, compare the initial load of LNG with the amount of the used boil-off gas to calculate the current volume of the LNG in the LNG storage tank, and reflect the volume of the LNG calculated from the flow rate of the fuel gas measured as described above in the volume of the LNG calculated by the LNG volume processing module 63. The allowable cut off pressure of the safety valve of the LNG storage tank and the volume of the LNG in the LNG storage tank calculated as described above are displayed on a display panel 65.

Figure 8:
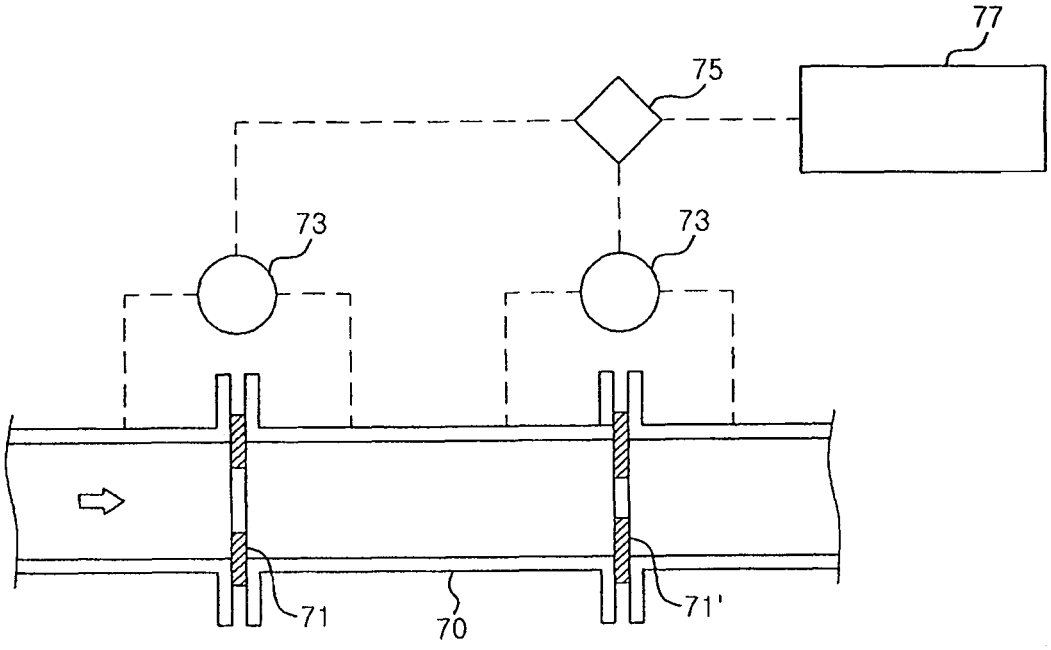
FIG. 8 illustrates a fuel gas flow meter of an LNG carrier according to an embodiment the present invention.

FIG. 8 illustrates a fuel gas flow meter for measuring the flow rate of the fuel gas of an LNG carrier according to an embodiment of the present invention. A differential pressure flow meter is used for measuring the flow rate of the fuel gas of an LNG carrier. In the flow meter, the measurement range is limited, and a large measurement error can occur for the flow rate out of the measurement range. To change the measurement range, an orifice itself should be replaced, which is an annoying and dangerous job.

Figure 9:
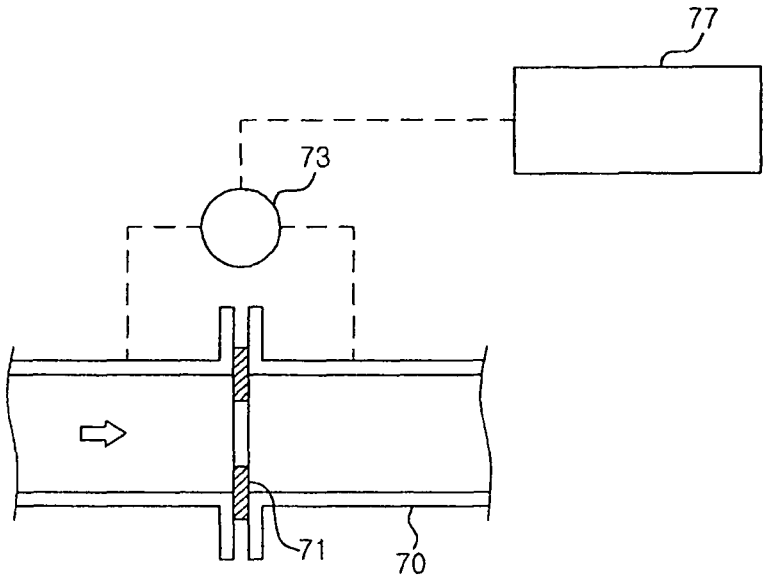
FIG. 9 illustrates a fuel gas flow meter of an exemplary LNG carrier.

In an exemplary configuration shown in FIG. 9, only one orifice was installed and consequently the measurement range was limited. But if two orifices having different measurement ranges are arranged in series as shown in FIG. 8, the effective measurement range can be expanded simply by selecting and using the proper measurement values of the orifices according to the flow rate.

That is to say, to measure a large range of the flow rate of fuel gas, the effective measurement range can be simply expanded by arranging at least two orifices in series, each orifice having a different measurement range, and selecting and using the appropriate measurement values of the orifices according to the flow rate. In FIG. 8, orifices 71 and 71', each having a different measurement range, are arranged in series in the middle of a fuel supply line pipe 70 for supplying a fuel gas from the LNG storage tank for an LNG carrier to fuel gas propulsion means. Differential pressure measurers 73 are connected to the fuel supply line pipe 70 of front and back portions of each of the orifices 71 and 71'. These differential pressure measurers 73 are selectively connected to the flow meter 77 through a selector 75 which is selectable according to the measurement range.

The effective measurement range can be simply expanded by installing the selector 75, which is selectable according to the measurement range as described above, between the differential pressure measurer 73 and the flow meter 77, and selecting and using the appropriate measurement values of the orifices according to the flow rate.

In an exemplary system, the capacity of a fuel gas orifice is set near NBOG (natural boil-off gas). Accordingly, in case of an LNG carrier whose consumption of boil-off gas is small, the accuracy in measurements is low. To make up for this inaccuracy, an embodiment of the present invention provides a method of additionally installing small orifices in series. This method can measure the level of the LNG in the LNG storage tank, thereby measuring the level, amount or volume, of the LNG in the LNG storage tank from the amount of LNG consumed. In order to improve accuracy, the composition of boil-off gas may be analyzed. For this, the composition of boil-off gas may be considered by adding gas chromatography.

Further, if the measurement of the level of LNG in the LNG storage becomes accurate by the above-mentioned methods, it can improve the efficiency of the boil-off gas management method and apparatus according to an embodiment of the present invention which maintains the pressure of the LNG storage tank at a somewhat higher than the prior art. That is, accurate measurement of the volume of LNG in an LNG storage tank can facilitate changing the setting of a safety valve of the LNG storage tank into multiple settings, and reduce the consumption of boil-off gas.

FIG. 9 illustrates an exemplary fuel gas flow meter for an LNG carrier. The fuel gas flow meter comprises only one orifice 71 for differential pressure type flow rate measuring of fuel gas, and consequently has a disadvantage of obtaining an effective measurement value within a specific measurement range.

Another Example of Circulation of LNG within the tank

Figure 10:
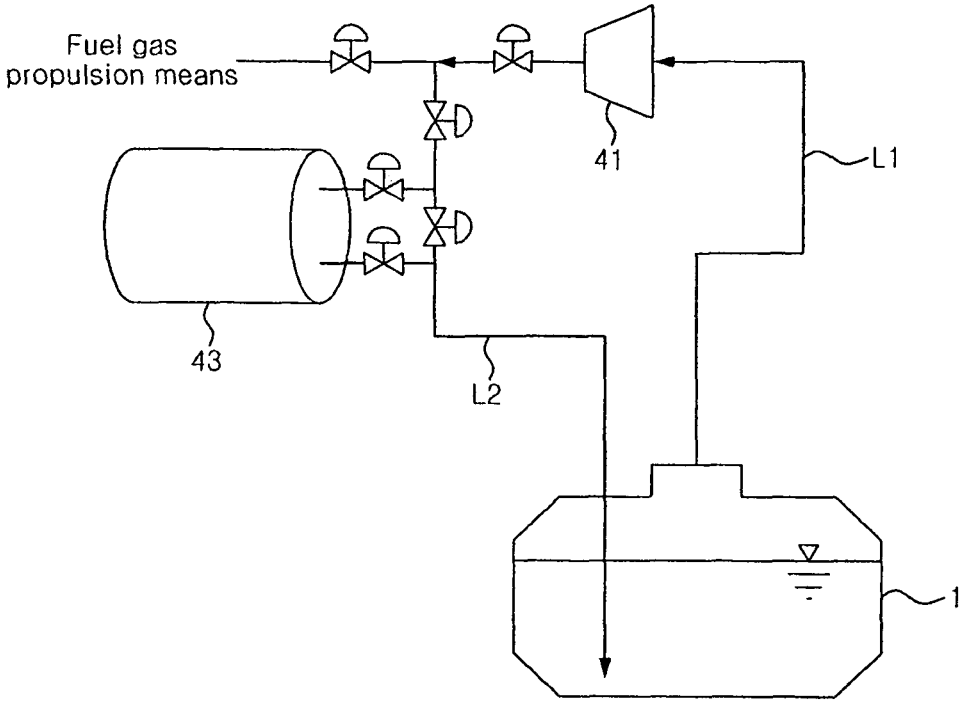
FIG. 10 illustrates a configuration of supplying boil-off gas, after being compressed, to a lower portion of an LNG storage tank according to an embodiment of the present invention.

FIG. 10 illustrates a supply of boil-off gas to a lower portion of an LNG storage tank after compressing the boil-off gas according to an embodiment of the present invention. An LNG carrier, which has fuel gas propulsion means using as a propulsion fuel the compressed boil-off gas by compressing the boil-off gas at an upper portion of the LNG storage tank for an LNG carrier, cannot use the fuel gas at all when passing a canal such as the Suez Canal, and consequently there is a great possibility of local increase in the temperature and pressure of the LNG storage tank. An additional boil-off gas extracting apparatus may be needed to solve this problem. That is, as illustrated in FIG. 10, a small amount of boil-off gas is extracted and compressed by a boil-off compressor (approximately 3 to 5 bar), and then put into a lower portion of the LNG storage tank 1.

To do this, a boil-off gas branch line L2 for returning the boil-off gas to the LNG storage tank 1 is installed in the middle of a fuel gas supply line L1 for compressing the boil-off gas at an upper portion of the LNG storage tank 1 for an LNG carrier and supplying the compressed boil-off gas to the fuel gas propulsion means. In addition, a compressor 41 is installed in the middle of the fuel gas supply line L1 upstream of a meeting point of the fuel gas supply line L1 and the boil-off gas branch line L2.

A buffer tank 43 is installed in the middle of the boil-off gas branch line L2. As there is a difference between the pressure of the boil-off gas passing the compressor 41 and the pressure of the LNG storage tank 1, it is desirable to temporarily store the boil-off gas passing the compressor 41 in the buffer tank 43 and control the pressure of the boil-off gas to match the pressure of the LNG storage tank 1 and then return the boil-off gas to the LNG storage tank 1. In one embodiment, it is desirable to operate an apparatus for reducing pressure increase in the LNG storage tank for an LNG carrier at an interval of about 10 minutes per 2 hours. Some examples of the fuel gas propulsion means are a double fuel diesel electric propulsion system (DFDE), a gas injection engine, and a gas turbine.

An LNG carrier, to which a DFDE, a gas injection engine, or a gas turbine is applied, uses the concept of compressing boil-off gas by a boil-off gas compressor and then sending the compressed boil-off gas to an engine to burn the boil-off gas. However, an LNG carrier which is configured to eliminate or reduce the discharge of boil-off gas of an LNG storage tank, as in an embodiment of the present invention, if no or a small amount of fuel gas is consumed in fuel gas propulsion means, to prevent a severe pressure increase due to a local increase in temperature in an LNG storage tank, compresses boil-off gas and then return the compressed boil-off gas to a lower portion of the LNG storage tank through a boil-off gas branch line, without sending the compressed boil-off gas to the gas engine.

Embodiment of Ship Consuming LNG from the Tank

An embodiment of the present invention provides a fuel gas supply system for gasifying the LNG of the LNG storage tank and supplying the gasified LNG as a fuel gas to fuel gas propulsion means. The system according to the embodiment may not use boil-off gas at all.

The LNG storage tank 1 for an LNG carrier used in the fuel gas supply system according to this embodiment is designed to have strength to withstand pressure increase due to boil-off gas so as to allow pressure increase due to boil-off gas generated in the LNG storage tank during the voyage of the LNG carrier.

Figure 11:
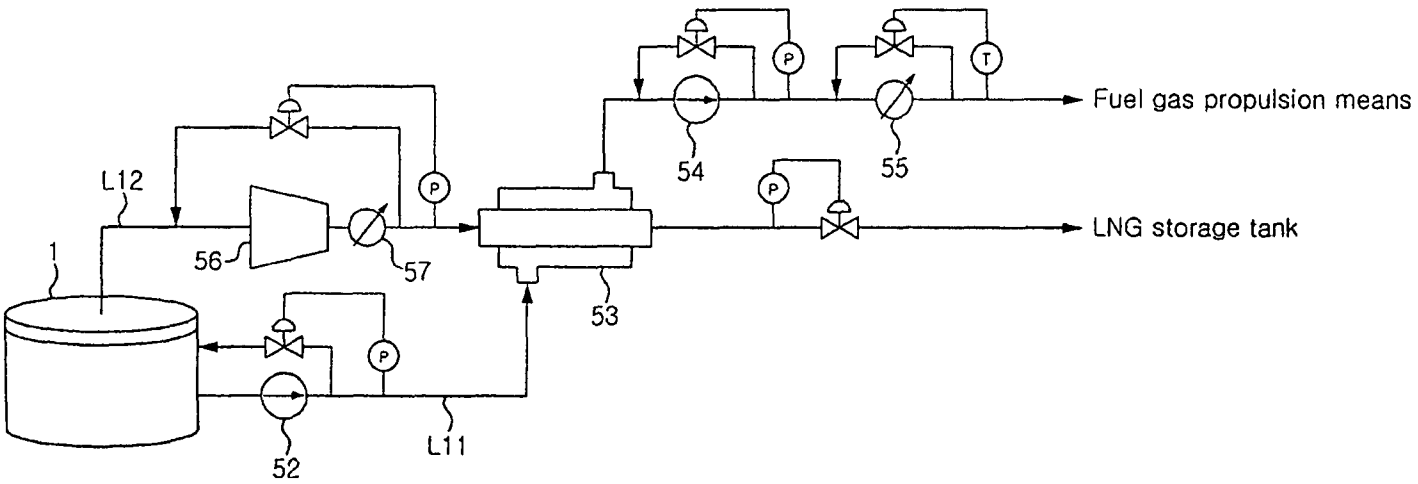
FIG. 11 is a schematic diagram illustrating a fuel gas supply system of an LNG carrier according to an embodiment of the present invention.

The fuel gas supply system in FIG. 11 comprises a fuel gas supply line L11 for extracting LNG from the LNG storage tank for an LNG carrier and supplying the extracted LNG to the fuel gas propulsion means, and a heat exchanger 53 provided in the middle of the fuel gas supply line L11, wherein the heat exchanger 53 exchanges heat between the LNG and boil-off gas extracted from the LNG storage tank 1. A first pump 52 is installed in the fuel gas supply line L11 upstream of the heat exchanger 53, so as to supply LNG, which has been compressed to meet the flow rate and pressure demands of the fuel gas propulsion means, to the fuel gas propulsion means. A boil-off gas liquefaction line L12 passes the heat exchanger 53 so as to extract boil-off gas from the upper portion of the LNG storage tank 1 and return the extracted boil-off gas to one side of the LNG storage tank 1.

LNG whose temperature is increased by exchanging heat with the boil-off gas in the heat exchanger 53 is supplied to the fuel gas propulsion means, and boil-off gas which has been liquefied by exchanging heat with the LNG is returned to the LNG storage tank 1. A second pump 54 is installed in the fuel gas supply line L11 downstream of the heat exchanger 53 so as to supply LNG to the fuel gas propulsion means after the LNG exchanges heat with the boil-off gas in the heat exchanger 53 and is compressed to meet the flow rate and pressure demands of the fuel gas propulsion means. A heater 55 is installed in the fuel gas supply line L11 downstream of the second pump 54 so as to heat LNG which has exchanges heat with the boil-off gas in the heat exchanger 53 to supply the LNG to the fuel gas propulsion means.

A boil-off gas compressor 56 and a cooler 57 are sequentially installed in the boil-off gas liquefaction line L12 upstream of the heat exchanger 53 so as to compress and cool the boil-off gas extracted from the LNG storage tank and then exchange heat between the boil-off gas and LNG.

In case the fuel gas pressure demand of the fuel gas propulsion means is high (e.g. about 250 bar), LNG is compressed to about 27 bar by the first pump 52, the temperature of the LNG, while passing the heat exchanger 53, is increased from approximately −163° C. to approximately −100° C., and the LNG is supplied in a liquid state to the second pump 54 and compressed to approximately 250 bar by the second pump 54 (as it is in a supercritical state, there is no division between liquid and gas states), then gasified, while being heated in the heater 55, and then supplied to the fuel gas propulsion means. In this case, though the temperature of LNG, while passing the heat exchanger 53, is increased, LNG, is not gasified because the pressure of LNG supplied to the heat exchanger is high.

On the other hand, in case the fuel gas pressure demand of the fuel gas propulsion means is low (e.g. about 6 bar), LNG is compressed to about 6 bar by the first pump 52, part of the LNG is gasified while passing the heat exchanger 53, supplied to the heater 55 and heated in the heater 55, and then supplied to the fuel gas propulsion means. In this case, the second pump 54 is not necessary.

According to this fuel gas supply system of an LNG carrier, LNG is extracted from the LNG storage tank, the extracted LNG is compressed to meet the flow rate and pressure demands of the fuel gas propulsion means, and the compressed LNG is supplied to the fuel gas propulsion means, but the supply of LNG to the fuel gas propulsion means is done after heat exchange between the LNG and boil-off gas extracted from the LNG storage tank. Accordingly, the fuel gas supply system has advantages of simplifying the configuration, reducing the required power, and preventing a severe increase in pressure of the LNG storage tank due to accumulation of boil-off gas therein, in supplying a fuel gas from an LNG carrier to the fuel gas propulsion means.

Liquefier

In one embodiment, a boil-off gas re-liquefaction apparatus or liquefier may be provided. The liquefier may use cold energy of LNG can be added. That is, boil-off gas is compressed and exchanges heat with the LNG of the fuel gas supply line, thereby being cooled (by the re-condenser, there is no N2 refrigerator). In this case, only 40-60% of NBOG is re-liquefied, but there is no problem because the LNG carrier according to an embodiment of the present invention is configured to eliminate or reduce the discharge of boil-off gas in the LNG storage tank. Further, if necessary, a small boil-off gas re-liquefaction apparatus having a processing capacity of approximately 1 ton/hour can be installed particularly for ballast voyage. The processing capacity is the maximum amount of gaseous phase LNG to be processed by the liquefier for one hour.

In one embodiment, the capacity processing of the liquefier is smaller than about 3,000 kg/hour. In certain embodiments, the processing capacity of the liquefier is about 50 kg/hour, about 100 kg/hour, about 200 kg/hour, about 300 kg/hour, about 500 kg/hour, about 700 kg/hour, about 900 kg/hour, about 1000 kg/hour, about 1200 kg/hour, about 1500 kg/hour, about 2000 kg/hour or about 3000 kg/hour. In some embodiments, the processing capacity may be within a range defined by two of the foregoing processing capacities.

In one embodiment, a ratio of the processing capacity to the storage capacity is smaller than about 0.015 kg/m$^3$. In certain embodiments, the ratio is about 0.001 kg/m$^3$, about 0.002 kg/m$^3$, about 0.003 kg/m$^3$, about 0.004 kg/m$^3$, about 0.005 kg/m$^3$, about 0.007 kg/m$^3$, about 0.009 kg/m$^3$, about 0.010 kg/m$^3$, about 0.011 kg/m$^3$, about 0.013 kg/m$^3$, about 0.015 kg/m$^3$, about 0.018 kg/m$^3$ or about 0.02 kg/m$^3$. In some embodiments, the ratio may be within a range defined by two of the foregoing ratios.

As stated above, embodiments of the present invention has advantages of reducing the waste of boil-off gas and increasing the flexibility in treatment of boil-off gas by allowing an increase in the vapor pressure and LNG temperature in an LNG storage tank for an LNG carrier having boil-off gas treating means during the transportation of the LNG.

Figure 4:
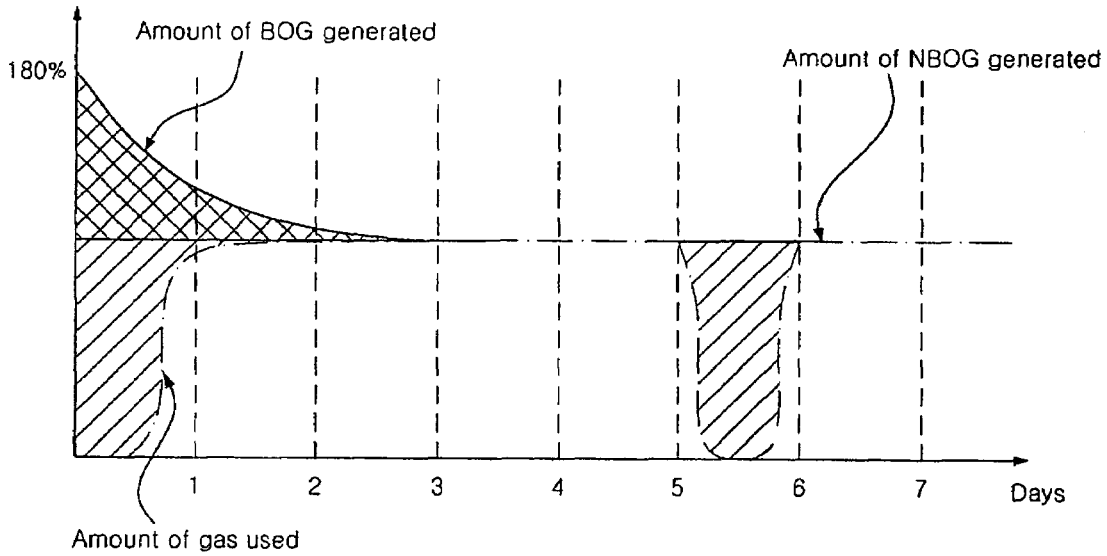
FIG. 4 is a diagram illustrating the waste of boil-off gas of an LNG carrier which basically maintains an almost constant pressure in an exemplary LNG storage tank.

In particular, according an embodiment of to the present invention, even when the amount of boil-off gas generated during the transportation of LNG exceeds the amount of boil-off gas consumed, the excessive boil-off gas can be preserved in the LNG storage tank without any loss of the boil-off gas, thereby improving the economic efficiency. For example, in case of an LNG carrier provided with an engine for treating boil-off gas as illustrated in FIG. 4, the excessive boil-off gas generated for a few days after loading LNG in the LNG carrier, or the excessive boil-off gas generated over the amount of boil-off gas consumed in an engine when the LNG carrier passes a canal or waits or maneuvers to enter port with LNG loaded therein, were mostly burnt by a GCU in the prior art, but this waste of boil-off gas can be reduced by the technology of an embodiment of the present invention.

Further, in one embodiment, in case the LNG carrier uses a dual fuel gas injection engine or gas turbine, the fuel gas can be supplied by a liquid pump, not by a boil-off gas compressor, thereby greatly reducing installation and operation costs.

Although embodiments of the present invention have been shown and described herein, it should be understood that various modifications, variations or corrections may readily occur to those skilled in the art, and thus, the description and drawings herein should be interpreted by way of illustrative purpose without limiting the scope and spirit of the present invention.

What is claimed is:

1. An LNG tank ship for transporting LNG, the LNG tank ship comprising:

an LNG tank containing liquid phase (LNG) and gaseous phase (boil-off gas);

a safety valve configured to release part of the boil-off gas from the tank when a vapor pressure within the tank exceeds a cut-off pressure of the safety valve, wherein the safety valve is configured to adjust the cut-off pressure within a range between a first value and a second value, the first value being 0.25 bar (gauge pressure) or below, the second value being between about 0.25 bar (gauge pressure) and about 2 bar (gauge pressure); and a liquid volume computing module configured to compute a current volume of LNG contained in the LNG tank;

wherein the cut-off pressure of the safety valve is adjusted at least based on the current volume.

2. The LNG tank ship of claim 1, further comprising a boil-off gas circulating device comprising a boil-off gas pathway and configured to suction boil-off gas of LNG from the LNG tank, to flow the boil-off gas through the boil-off gas pathway and to return the boil-off gas to the LNG tank without liquefying the boil-off gas.

3. The LNG tank ship of claim 2, wherein the boil-off gas circulating device further comprises a compressor configured to compress at least part of the boil-off gas that flows through the boil-off gas pathway.

4. The LNG tank ship of claim 2, wherein the boil-off gas is suctioned through an intake port located at or near a top surface of the LNG tank.

5. The LNG tank ship of claim 2, wherein the intake port is substantially distanced from an interior surface of the LNG tank.

6. The LNG tank ship of claim 2, wherein the boil-off gas circulating device further comprises a branch pathway branching from the boil-off gas pathway.

7. The LNG tank ship of claim 2, wherein the boil-off gas returns to the LNG tank through a plurality of orifices.

8. The LNG tank ship of claim 1, wherein the boil-off gas pathway comprises a portion located outside the LNG tank.

9. The LNG tank ship of claim 1, wherein the boil-off gas pathway throughout is located inside the LNG tank.

10. The LNG tank ship of claim 1, wherein the LNG tank is integrated with a body of the ship.

11. A method of processing LNG contained in an LNG tank ship, the method comprising:

providing the LNG tank ship of claim 2;

computing a current volume of LNG contained in the LNG tank;

adjusting the cut-off pressure of the safety valve at least based on the computed volume;

suctioning, through an intake port, boil-off gas from an upper portion of the LNG tank;

flowing, through the boil-off gas pathway, boil-off gas from the intake port toward the discharge port; and discharging, through a discharge port, boil-off gas from the boil-off gas pathway into a lower portion of the LNG tank.

12. The method of claim 11, further comprising:

compressing at least part of boil-off gas flowing in the boil-off gas pathway toward the discharge port; and flowing compressed boil-off gas toward the discharge port.

13. The method of claim 11, further comprising:

loading LNG into the LNG tank at a first time, wherein the cut-off pressure is set at a first value during loading;

subsequently consuming or releasing at least part of the boil-off gas from the LNG tank; and adjusting the cut-off pressure to a second value that is higher than the first value.

14. The method of claim 11, wherein substantially no liquid phase LNG is suctioned through the intake port.

15. The method of claim 11, wherein the discharge port is submerged in liquid phase LNG.

16. The method of claim 11, further comprising:

unloading liquid phase LNG from the LNG tank;

gasifying the liquid phase LNG to gaseous phase LNG; and supplying the gaseous phase LNG to an LNG infrastructure for supplying LNG to consumers.

* * * * *